US009255318B2

(12) United States Patent
Ono et al.

(10) Patent No.: US 9,255,318 B2
(45) **Date of Patent: *Feb. 9, 2016**

(54) HIGH-STEEL GALVANIZED STEEL SHEET AND METHOD FOR MANUFACTURING THE SAME

(75) Inventors: Yoshihiko Ono, Hiroshima (JP); Kenji Takahashi, Hiroshima (JP); Kaneharu Okuda, Chiba (JP); Shoichiro Taira, Hiroshima (JP); Michitaka Sakurai, Hiroshima (JP); Yusuke Fushiwaki, Hiroshima (JP)

(73) Assignee: JFE Steel Corporation (JP)

( * ) Notice: Subject to any disclaimer, the term of this patent is extended or adjusted under 35 U.S.C. 154(b) by 992 days.

This patent is subject to a terminal disclaimer.

(21) Appl. No.: 13/380,371

(22) PCT Filed: Jun. 25, 2010

(86) PCT No.: PCT/JP2010/061296

§ 371 (c)(1),
(2), (4) Date: Jan. 31, 2012

(87) PCT Pub. No.: WO2010/150919

PCT Pub. Date: Dec. 29, 2010

(65) Prior Publication Data

US 2012/0118439 A1 May 17, 2012

(30) Foreign Application Priority Data

Jun. 26, 2009 (JP) ..... 2009-151747

(51) Int. Cl.

| | |
|---|---|
| ***C22C 38/04*** | (2006.01) |
| ***C23C 2/02*** | (2006.01) |
| ***C21D 9/46*** | (2006.01) |
| ***C22C 38/00*** | (2006.01) |
| ***C22C 38/02*** | (2006.01) |
| ***C22C 38/06*** | (2006.01) |
| ***C22C 38/22*** | (2006.01) |
| ***C22C 38/32*** | (2006.01) |
| ***C22C 38/38*** | (2006.01) |
| ***C23C 2/06*** | (2006.01) |
| ***C23C 2/28*** | (2006.01) |

(52) U.S. Cl.

CPC ... *C23C 2/02* (2013.01); *C21D 9/46* (2013.01); *C22C 38/001* (2013.01); *C22C 38/02* (2013.01); *C22C 38/04* (2013.01); *C22C 38/06* (2013.01); *C22C 38/22* (2013.01); *C22C 38/32* (2013.01); *C22C 38/38* (2013.01); *C23C 2/06* (2013.01); *C23C 2/28* (2013.01)

(58) Field of Classification Search

CPC ..... C22C 38/00–38/04
USPC ..... 148/320, 333, 506, 533, 579, 648, 148/650–654; 420/104; 428/659, 684
See application file for complete search history.

(56) References Cited

U.S. PATENT DOCUMENTS

| | | | | |
|---|---|---|---|---|
| 2003/0111144 | A1 * | 6/2003 | Matsuoka et al. | 148/603 |
| 2009/0139611 | A1 * | 6/2009 | Kimura et al. | 148/533 |

FOREIGN PATENT DOCUMENTS

| | | |
|---|---|---|
| JP | 57-057945 | 4/1982 |
| JP | 63-250442 | 10/1988 |

(Continued)

*Primary Examiner* — Brian Walck
(74) *Attorney, Agent, or Firm* — DLA Piper LLP (US)

(57) ABSTRACT

A high-strength galvanized steel sheet has a low YP, good stretch flangeability, and excellent corrosion resistance and contains, on a percent by mass basis, more than 0.015% to less than 0.10% of C, 0.5% or less of Si, 1.0% to 1.9% of Mn, 0.015% to 0.050% of P, 0.03% or less of S, 0.01% to 0.5% of sol. Al, 0.005% or less of N, less than 0.40% of Cr, 0.005% or less of B, less than 0.15% of Mo, 0.4% or less of V, and less than 0.020% of Ti, in which 2.2≤[Mneq]≤3.1 and [% Mn]+3.3[% Mo]≤1.9, and [% Mn]+3.3[% Mo])/(1.3[% Cr]+8[% P]+150B*)<3.5 are satisfied.

16 Claims, 4 Drawing Sheets

(56) References Cited

FOREIGN PATENT DOCUMENTS

| | | |
|---|---|---|
| JP | 04-157134 | 5/1992 |
| JP | 62/40405 | 8/1994 |
| JP | 08-134591 | 5/1996 |
| JP | 10-259448 | 9/1998 |
| JP | 2002-069574 | 3/2002 |
| JP | 2002-235145 | 8/2002 |
| JP | 3613129 | 11/2004 |
| JP | 2006-233294 | 9/2006 |
| JP | 2008-019502 | 1/2008 |
| JP | 2008-255484 | 10/2008 |
| JP | 2009-035815 | 2/2009 |

* cited by examiner

HIGH-STEEL GALVANIZED STEEL SHEET AND METHOD FOR MANUFACTURING THE SAME

CROSS REFERENCE TO RELATED APPLICATIONS

This is a §371 of International Application No. PCT/JP2010/061296, filed on Jun. 25, 2010 (WO 2010/150919, published on Dec. 29, 2010), which claims priority of Japanese Patent Application No. 2009-151747, filed on Jun. 26, 2009, the entire contents of which are hereby incorporated by reference.

TECHNICAL FIELD

This disclosure relates to a high-strength galvanized steel sheet for press forming which is used for automobiles, household electric appliances, and the like through a press forming process and a method for manufacturing the same.

BACKGROUND

In the past, BH steel sheets of a TS: 340 MPa class bake-hardenable steel sheets (hereinafter referred to as "340BH") have been applied to automobile exposure panels, such as hoods, doors, trunk lids, backdoors, and fenders, which are required to have excellent dent resistance. The 340BH is ferrite single phase steel in which in ultra low carbon steel containing less than 0.01% of carbon, the amount of solute carbon is controlled by addition of carbide or nitride forming elements such as Nb and Ti, and solid solution strengthening is performed by addition of Si, Mn, and P. In recent years, from the further demand for the weight reduction of automotive bodies, various investigations have been carried out to increase the strength of the exposure panels to which the 340BH has been applied, to achieve a reduction in the thickness of the steel sheet, a weight reduction in the R/F (Reinforcement: inner reinforcement parts) with the same thickness of outer panels, a reduction in the temperature and the time in a bake coating process, and the like.

However, if large amounts of Si, Mn, and P are further added to the conventional 340BH to increase the strength thereof, surface distortion of pressed parts considerably deteriorates due to an increase in YP. In this case, the surface distortion indicates minute wrinkles and/or undulated patterns which are likely to occur on a press formed surface such as a periphery of a door knob portion. Since the surface distortion remarkably degrades the appearance quality of automobiles, steel sheets applied to the exposure panels are required to have low yield stress before press forming which is close to YP of the present 340BH while the strength of a press formed product is increased.

In addition, in press forming of the parts, although bending is performed on a flange portion to join to inner parts, if the ductility of an edge of a sheared or punched blank, that is so-called "stretch-flangeability," is not sufficient, cracks generate at the edge. For example, if the stretch-frangeability is deteriorated by increasing tensile strength from that of 340BH, cracks often generate on the edge of flanges by hemming the flanges of periphery of backdoors or window frame of doors, or by bending the edge of flanges of fenders to join to side-panels. Accordingly, a steel sheet used for the applications as described above is required to have excellent stretch flangeability.

Furthermore, a steel sheet used for automobiles is also required to have excellent corrosion resistance. Since steel sheets are closely in contact with each other at a hem processing portion and a spot welding peripheral portion of body parts such as a door, a hood, and trunk lid, chemical films are difficult to form by electrocoating. Hence, rust easily forms. In particular, in corner portions at a front side of a hood and a lower side of a door, at which water is liable to remain and which are exposed to a wet atmosphere for a long time, holes are frequently generated by rust. Furthermore, in recent years, car body manufactures have been considering increasing the hole-forming resistant life to 12 years from a conventional life of 10 years by improving corrosion resistance of car bodies. Hence, a steel sheet must have sufficient corrosion resistance.

Because of these circumstances, for example, in Japanese Examined Patent Application Publication No. 57-57945, a method for obtaining a high-strength steel sheet of a 340 to 490 MPa grade is disclosed in which the amount of Ti is controlled in steel containing 0.02% or less of C so that Ti(%)/C(%)≥4.0 holds, and large amounts of Si, Mn, and P are added.

In addition, Japanese Examined Patent Application Publication No. 62-40405 discloses a method for obtaining a galvannealed steel sheet having both a low yield stress (YP) and a high ductility (El) by appropriately controlling a cooling rate of steel containing 0.005% to 0.15% of C, 0.3% to 2.0% of Mn, and 0.023% to 0.8% of Cr after annealing to form a dual phase microstructure primarily formed from ferrite and martensite.

In addition, Japanese Patent No. 3613129 discloses that when the total amount of Mn, Cr, and Mo is set to 1.8% to 2.5% in steel containing 0.02% to 0.033% of C, 1.5% to 2.5% of Mn, 0.03% to 0.5% Cr, and 0% to 0.5% Mo, a steel sheet having a YP of 300 MPa or less, excellent ductility (El), and excellent stretch flangeability (hole expanding ratio, λ) is obtained.

Japanese Unexamined Patent Application Publication No. 8-134591 discloses a method for obtaining a high-strength galvanized steel sheet having a tensile strength of a 440 to 590 MPa class and excellent stretch flangeability (hole expanding ratio, λ) in which the total amount of Mn and Cr of steel containing 0.02% to 0.14% of C, 1.3% to 3.0% of Mn, and 0.3% to 1.5% of Cr is set to 2.0% to 3.5%, and a microstructure of the steel sheet is formed as a multi phase, on an area ratio basis, of 50% or more of a ferrite phase, 3% to 15% of bainite, and 5% to 20% of martensite.

Japanese Unexamined Patent Application Publication No. 2008-19502 discloses a method for obtaining a steel sheet having a low yield ratio, high BH, and excellent room-temperature anti-aging property which is obtained by setting Cr/Al to 30 or more in steel containing 0.02% to 0.08% of C, 1.0% to 2.5% of Mn, 0.05% or less of P, and more than 0.2% to 1.5% of Cr.

In Japanese Unexamined Patent Application Publication No. 2006-233294, a method for obtaining a steel sheet having a low YR and high bake-hardenability is disclosed in which steel containing 0.01% to less than 0.040% of C, 0.3% to 1.6% of Mn, 0.5% or less of Cr, and 0.5% or less of Mo is cooled to a temperature of 550° C. to 750° C. at a cooling rate of 3° C. to 20° C./s after annealing and is cooled at a cooling rate of 100° C./s or more to a temperature of 200° C. or less.

However, since the steel sheet disclosed in JP '945 is IF steel in which C is stabilized by Ti and is ferrite single phase steel, as a strengthening mechanism, solid solution strengthening of Si, Mn, and P must be inevitably used Hence, YP is increased by adding large amounts of these elements, and appearance quality and powdering resistance of zinc-coated steel sheets are remarkably degraded.

The methods described in JP '405 and JP '129 disclose the steel in which an appropriate amount of a second phase primarily composed of martensite is dispersed in a ferrite microstructure, and YP is decreased as compared to that of solid solution strengthened steel, such as conventional IF steel. However, when press forming is performed on these steel to form body parts such as a door, there are many steel sheets having a large surface distortion amount as compared to that of the conventional 340BH. Hence, a further decrease in YP is required. In addition, since steel sheets often accompany cracks after bending of a flange end, further improvement in stretch flangeability is also required. Furthermore, when we investigated corrosion resistance of actual parts such as hoods and doors using the steel described above, it became clear that some steel sheets described in the examples had remarkably inferior corrosion resistance to that of the conventional 340BH at a portion at which the steel sheets were in close contact with each other. In addition, large amounts of expensive elements such as Cr and Mo, are added to many steel sheets described in these examples. Hence, the costs thereof remarkably increased.

In addition, since the steel described in JP '591 includes bainite as a microstructure, YP is high, and sufficient surface precision of pressed parts cannot be obtained. Furthermore, as in the case described above, it became clear that many steel sheets described in the examples had insufficient corrosion resistance.

Since Cr is positively used, the steel described in JP '502 has a relatively low YP and a high hole expanding property. However, as in the case described above, it became clear that many steel sheets described in the examples had insufficient corrosion resistance. In addition, since large amounts of expensive elements such as Cr and Mo, are added to these steel sheets, the costs thereof increased.

In addition, since the method described in JP '294 requires rapid cooling after annealing, it can be applied to a continuous annealing line (CAL) which performs no plating treatment. However, it is theoretically difficult to apply the above method to a current continuous galvanizing line (CGL) in which a plating treatment is performed by immersing a steel sheet in a galvanizing bath held at 450° C. to 500° C. during cooling after annealing.

As described above, a galvanized steel sheet which can satisfy all requirements, good corrosion resistance, a low YP, and excellent stretch flangeability, could not be obtained by conventional techniques.

It could therefore be helpful to provide a high-strength galvanized steel sheet which does not require addition of large amounts of expensive elements such as Mo and Cr, and which has excellent corrosion resistance, a low YP, and good stretch flangeability, and a method for manufacturing the same.

SUMMARY

We conducted extensive research on a method for simultaneously achieving a low YP and an excellent stretch-flangeability without using expensive elements while improving the corrosion resistance on conventional Dual-Phase steel sheets having a low yield strength. We discovered the following:

(I) To increase λ in dual phase steel composed of ferrite and a second phase, microstructure of easer ferrite+bainite, ferrite+martensite, and ferrite+retained γ must be selected. In particular, since pearlite generated adjacent to hard martensite deteriorates considerably the stretch flangeability in steel containing martensite, when the amount of pearlite is sufficiently decreased in steel having the microstructure as described above, the stretch flangeability is significantly improved.

(II) To decrease YP while λ is increased, the microstructure mentioned above must be mainly composed of ferrite and martensite or a microstructure additionally containing a small amount of retained γ to it. That is, since bainite increases YP, the amount thereof must be sufficiently decreased as in the case of pearlite. In addition, since YP is significantly decreased when a small amount of martensite is dispersed, martensite having a volume fraction of 1% to 10% must be contained. Since having a small influence on YP, retained γ having a volume fraction of 5% or less can be contained. However, steel having sufficient surface distortion resistance cannot be obtained by the microstructure described above and, to decrease YP further more while excellent stretch flangeability is maintained, martensite and retained γ must be uniformly and coarsely dispersed at triple points of grain boundaries.

(III) To improve corrosion resistance, the content of Cr must be decreased to less than 0.40%, and at the same time, the contents of Mn and P must be appropriately controlled.

Features I-III can be achieved such that the Mn equivalent, which will be described later, is set as high as 2.2 or more, while the amounts of Mn, Mo, and Cr are decreased, P and B are positively used, and a heating rate in annealing is controlled to less than 5.0° C./sec.

That is, to improve the corrosion resistance of dual-phase steel of a 390 to 590 MPa class to correspond to that of mild steel or the 340BH, the content of Cr must be at least controlled to less than 0.40%. However, when the content of Cr is decreased, since the Mn equivalent is excessively decreased, pearlite is generated, and stretch flangeability is remarkably degraded, and when large amounts of Mn and Mo are added in steel in which the content of Cr is decreased, since ferrite grains and martensite grains are excessively refined, YP is remarkably increased. Hence, good corrosion resistance and good mechanical properties cannot be simultaneously obtained. On the other hand, P (phosphorus) and B (boron) each function to uniformly and coarsely disperse the second phase. Furthermore, a decrease in heating rate in the annealing process also functions to uniformly disperse the second phase. In addition, Mn and P each function to slightly improve the corrosion resistance. Therefore, when P and/or B is added while the amounts of Mn, Mo, and Cr are controlled respectively in a predetermined range, and the heating rate in an annealing process is decreased, steel which satisfies the requirements of good corrosion resistance, a low YP, and high stretch flangeability can be obtained. Furthermore, since addition of large amounts of expensive elements such as Mo or Cr, is not necessary, manufacturing can be performed at a low cost.

We thus provide:

[1] A high-strength galvanized steel sheet comprises: as chemical compositions of steel, on a percent by mass basis, more than 0.015% to less than 0.10% of C, 0.5% or less of Si, 1.0% to 1.9% of Mn, 0.015% to 0.050% of P, 0.03% or less of S, 0.01% to 0.5% of sol. Al, 0.005% or less of N, less than 0.40% of Cr, 0.005% or less of B, less than 0.15% of Mo, 0.4% or less of V, less than 0.020% of Ti, and the balance being iron and inevitable impurities, in which $2.2 \leq [Mneq] \leq 3.1$, $[\% Mn]+3.3[\% Mo] \leq 1.9$, and $[\% Mn]+3.3[\% Mo])/(1.3[\% Cr]+8[\% P]+150B^*) < 3.5$ are satisfied; wherein as the microstructure of the steel, ferrite and a second phase are present, the volume fraction of the second phase is 2% to 12%, the second phase includes martensite having a volume fraction of 1% to 10% and retained γ having a volume fraction of 0% to 5%, the ratio of the volume fraction of martensite and retained γ in the second phase is 70% or more, and the ratio of the volume fraction of part of the second phase present at grain boundary triple points to that of the second phase is 50% or more. In this case, [Mneq] indicates [% Mn]+1.3[% Cr]+8[% P]+150B*+2[% V]+3.3[% Mo], B* indicates [% B]+[% Ti]/48×10.8×0.9+[% Al]/27×10.8×0.025, and [% Mn], [% Cr], [% P], [% B], [% Ti], [% Al], [% V], and [% Mo] indicate contents of Mn, Cr, P, B, Ti, sol. Al, V, and Mo, respectively. In addition, [% B]=0 is represented by B*=0, and B*0.0022 is represented by B*=0.0022.

[2] In the high-strength galvanized steel sheet described in [1], ([% Mn]+3.3[% Mo])/(1.3[% Cr]+8[% P]+150B*)<2.8 holds.

[3] The high-strength galvanized steel sheet described in [1] or [2] further comprises, on a percent by mass basis, at least one of less than 0.02% of Nb, 0.15% or less of W, and 0.1% or less of Zr.

[4] The high-strength galvanized steel sheet described in one of [1] to [3] further comprises, on a percent by mass basis, at least one of 0.5% or less of Cu: 0.5% or less of Ni, 0.01% or less of Ca, 0.01% or less of Ce, 0.01% or less of La, and 0.01% or less of Mg.

[5] The high-strength galvanized steel sheet described in one of [1] to [4] further comprises, on a percent by mass basis, at least one of 0.2% or less of Sn and 0.2% or less of Sb.

[6] A method for manufacturing a high-strength galvanized steel sheet comprises the steps of: performing hot rolling and cold rolling of a steel slab having the chemical composition described in one of [1] to [5]; then in a continuous galvanizing line (CGL), performing heating in a range of 680° C. to 750° C. at an average heating rate of less than 5.0° C./sec; subsequently performing annealing at an annealing temperature in a range of 750° C. to 830° C.; performing cooling to set an average cooling rate from the annealing temperature to immersion in a galvanizing bath to 2° C. to 30° C./sec and to set a holding time in a temperature region of 480° C. or less to 30 seconds or less; then performing galvanizing by the immersion in the galvanizing bath; and performing cooling to 300° C. or less at an average cooling rate of 5° C. to 100° C./sec after the galvanizing, or further performing an alloying treatment after the galvanizing, and performing cooling to 300° C. or less at an average cooling rate of 5° C. to 100° C./sec after the alloying treatment.

A high-strength galvanized steel sheet having excellent corrosion resistance, a low YP, and excellent stretch flangeability can be manufactured at a low cost. Since the high-strength galvanized steel sheet has excellent corrosion resistance, surface distortion resistance, and stretch flangeability, the strengths of automotive parts can be increased, and the thicknesses thereof can be decreased.

DETAILED DESCRIPTION

Figure 1:
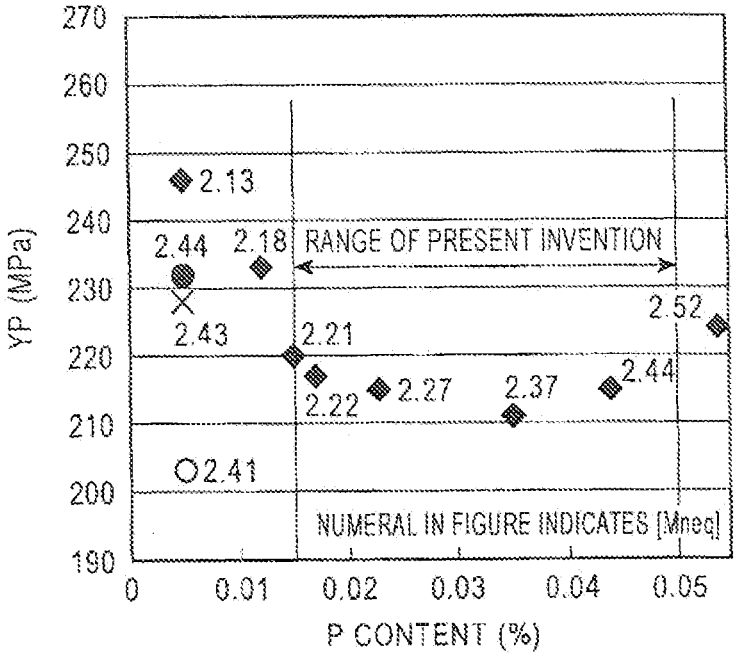
FIG. 1 is a graph showing the relationship between YP and P content.

Hereinafter, our steel sheets and methods will be described in detail. Incidentally, % indicating the amount of each component is on a percent by mass basis unless otherwise particularly noted.

1) Chemical composition of steel

Cr: less than 0.40%

Cr is an important element to be strictly controlled. That is, although positively used in the past to decrease YP and improve the stretch flangeability, Cr is an expensive element, and it also became clear that when a large amount thereof was added, the corrosion resistance of a hemmed portion was remarkably degraded. That is, when body parts such as a door outer and a hood outer, were formed from conventional dual-phase steel having a low YP, and the corrosion resistance thereof was evaluated under a wet environment, it was observed that the hole-forming resistant life of a hemmed portion was decreased from that of conventional steel by 1 to 4 years. For example, the hole-forming resistant life of steel in which 0.42% of Cr is added is decreased by 1 year, and the hole-forming resistant life of steel in which 0.60% of Cr is added is decreased by 2.5 years compared to that of conventional 340BH steel sheets. It became clear that the decrease in hole-forming resistant life was small when the content of Cr was less than 0.40% and hardly occurred when the content of Cr was less than 0.30%. Therefore, to ensure good corrosion resistance, the content of Cr must be set to less than 0.40%. Furthermore, to impart more excellent corrosion resistance, the content of Cr is preferably set to less than 0.30%. Although Cr is an element which can be arbitrarily added to appropriately control [Mneq] shown below, and the lower limit of Cr is not specified (0% of Cr is included), to decrease YP, 0.02% or more of Cr is preferably added, and 0.05% or more thereof is more preferably added.

[Mneq]: 2.2 to 3.1

To ensure low YP maintaining excellent stretch-flangeability, it is at least necessary to form a composite microstructure consisting of ferrite and martensite as a predominant microstructure. In conventional steel, there are many steel sheets, the stretch flangeability of which is not excellent, or YP or YR of which is not sufficiently decreased. According to the result obtained from investigation, it became clear that in a steel sheet having inferior stretch flangeability, pearlite was generated as the second phase besides martensite and a small amount of retained γ, and that in a steel sheet having a high YP, pearlite or bainite was generated besides martensite and a small amount of retained γ. Since this pearlite is easy to be generated adjacent to hard martensite and to function as an origin of a crack in a sheared edge, even if its content is very small in steel containing martensite, the stretch flangeability is remarkably degraded. In addition, bainite is a hard phase and considerably increases YP.

Fine grains having a size of approximately 1 to 2 μm generated adjacent to martensite, pearlite and bainite are difficult to be discriminated from martensite by an optical microscope and can only be discriminated using a SEM at a magnification of 3,000 times or more. For example, when the microstructure of conventional steel containing 0.03% of C, 1.5% of Mn, and 0.5% of Cr is investigated in detail, only coarse pearlite is identified by observation using an optical microscope or by observation using a SEM at a magnification of approximately 1,000 times, and the volume fraction of pearlite or bainite occupied in the volume fraction of the second phase is measured as approximately 10%. However, according to detailed investigation by SEM observation at a magnification of 4,000 times, the ratio of pearlite or bainite occupied in the volume fraction of the second phase is 30% to 40%. When pearlite or bainite as described above is controlled, a low YP and high stretch flangeability can be simultaneously obtained.

In CGL heat cycles in which slow cooling is performed after annealing, to sufficiently decrease the amounts of fine pearlite or bainite as described above, the hardenability of each element was investigated. As a result, it became clear that in addition to Mn, Cr, Mo, V, and B which have been well known as a hardening element, P also had a significant hardenability improvement effect. In addition, when B was collectively added with Ti and/or Al, the hardenability improvement effect was significantly increased. However, even if a predetermined amount thereof or more was added, the hardenability improvement effect was saturated. Hence, we found that these effects can be represented by an Mn equivalent formula as shown below.

$$[Mneq]=[\%\ Mn]+1.3[\%\ Cr]+8[\%\ P]+150B^*+2[\%\ V]+3.3[\%\ Mo]$$

$$B^*=[\%\ B]+[\%\ Ti]/48\times10.8\times0.9+[\%\ Al]/27\times10.8\times0.025$$

In this formula, [% B]=0 is represented by B*=0, and B*≥0.0022 is represented by B*=0.0022. In this formula, [% Mn], [% Cr], [% P], [% B], [% V], [% Mo], [% Ti], and [% Al] represent the contents of Mn, Cr, P, B, V, Mo, Ti, and sol. Al, respectively.

B* is an index showing the effect of improving hardenability by remaining solute B by addition of B, Ti, and Al, and in steel in which no B is added, since the effect by the addition of B is not obtained, B*=0 holds. In addition, in the case of B*≥0.0022, since the effect of improving hardenability by B is saturated, B* is 0.0022.

When this [Mneq] is 2.2 or more, even in the CGL heat cycles in which slow cooling is performed after annealing, generation of pearlite and bainite is sufficiently suppressed. Therefore, to ensure excellent stretch flangeability while YP is decreased, [Mneq] must be 2.2 or more. Furthermore, to further decrease YP and improve the stretch flangeability, [Mneq] is preferably 2.3 or more and more preferably 2.4 or more. When [Mneq] is more than 3.1, since the amounts of Mn, Mo, Cr, P are excessively increased, it becomes difficult to ensure a sufficiently low YP and excellent corrosion resistance at the same time. Therefore, [Mneq] is 3.1 or less.

Mn: 1.0% to 1.9%

As described above, although [Mneq] must be at least appropriately controlled to improve stretch flangeability while YP is decreased, sufficient results cannot be obtained only by this control, and the content of Mn and the contents of Mo, P, and B, which will be described later, must also be controlled in respective predetermined ranges. That is, since Mn improves hardenability and increases the ratio of martensite in the second phase, this element is added. However, when the content thereof is excessively high, the temperature of transformation from α to γ in an annealing process is decreased, and γ grains are generated at fine ferrite grain boundaries immediately after recrystallization or at interfaces of recovered grains during recrystallization. As a result, as ferrite grains are expanded and become non-uniform, the second phase is refined and YP is increased. Hence, the amount of Mn is 1.9% or less. On the other hand, when the amount of Mn is excessively small, even if a large amount of another element is added, it is difficult to ensure sufficient hardenability. In addition, many MnS are finely dispersed, so that the corrosion resistance is degraded. To ensure sufficient hardenability and corrosion resistance, it is necessary to add at least 1.0% or more of Mn. Therefore, the amount of Mn is 1.0% to 1.9%. To further improve the corrosion resistance, the amount of Mn is preferably set to 1.2% or more, and to further decrease YP, the amount of Mn is preferably 1.8% or less.

Mo: less than 0.15%

Mo can be added to suppress generation of pearlite by improving the hardenability and improve the stretch flangeability. However, Mo has a strong function of refining the second phase as in the case of Mn and also has a strong function of refining ferrite grains. Therefore, when Mo is excessively added, YP is remarkably increased. In addition, since Mo is a very expensive element, when the amount thereof is large, the cost is considerably increased. Hence, to decrease YP and reduce cost, the amount of Mo is limited to less than 0.15% (0% is included). To further decrease YP, the amount of Mo is preferably 0.05% or less and is more preferably 0.02% or less. It is most preferable when Mo is not contained.

$$[\%\ Mn]+3.3[\%\ Mo]\leq1.9$$

To decrease YP, in addition to the contents of Mn and Mo, the contents thereof must be limited to a predetermined range. Since YP is increased when [% Mn]+3.3[% Mo], which is a weighting equivalent formula of these contents, is more than 1.9, [% Mn]+3.3[% Mo] must be 1.9 or less.

P: 0.015% to 0.050%

P is an important element which achieves a decrease in YP and an improvement in stretch flangeability. That is, when P is contained in a predetermined range together with Cr and B, which will be described later, a decrease in YP and excellent stretch flangeability are simultaneously obtained at a low manufacturing cost, and excellent corrosion resistance can also be ensured.

P has been used as a solid solution strengthening element, and it has been believed that to decrease YP, the content thereof is preferably decreased. However, as described above, it became clear that even by addition of a small amount of P, a significant effect of improving the hardenability was obtained, and furthermore, P has an effect of uniformly and coarsely dispersing the second phase at the triple points of ferrite grain boundaries. Hence, it became clear that YP was decreased by using P instead of Mn or Mo even at the same Mn equivalent. In addition, it also became clear that P had an effect of improving the balance between strength and stretch flangeability and improved the corrosion resistance. Therefore, when the amounts of Mn and Mo are decreased by using P as a hardening element, a low YP and high stretch flangeability can be simultaneously obtained, and when the amount of Cr is decreased by using P, the corrosion resistance is significantly improved.

Figure 2:
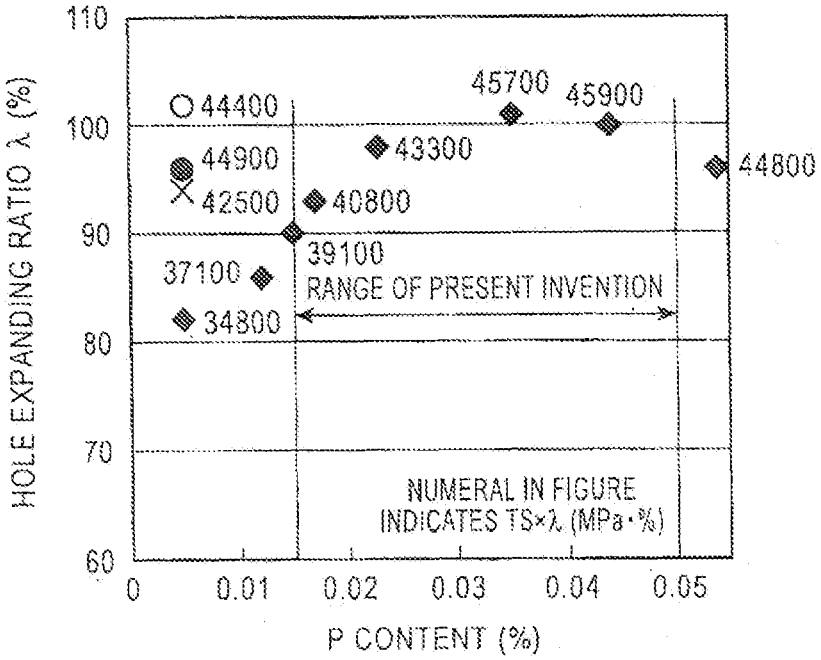
FIG. 2 is a graph showing the relationship between hole expanding ratio and the P content.

FIGS. 1 and 2 show the results obtained by investigation on the relationship between YP and the stretch flangeability (hole expanding ratio: λ) of steel (mark ◆) containing 0.028% of C, 0.01% of Si, 1.6% of Mn, 0.005% to 0.054% of P, 0.005% of S, 0.05% of sol. Al, 0.20% of Cr, 0.003% of N, and 0.001% of B. In addition, for the purpose of comparison, properties of high Mn steel (mark x) containing 1.9% of Mn, high Cr steel (mark ○) containing 0.42% of Cr, and high Mo steel (mark ●) containing 0.18% of Mo and a trace of Cr are also shown. In comparative steel, the contents of the other elements are the same as those of the base steel in which the content of P is changed.

A test piece was formed by the following method. That is, after a slab having a thickness of 27 mm was heated to 1,200° C., and hot rolling was then performed to form a sheet having a thickness of 2.8 mm at a finish rolling temperature of 850° C., water spray cooling was performed immediately after the rolling, and a coiling treatment was performed at 570° C. for 1 hour. In addition, cold rolling was performed to form a sheet having a thickness of 0.75 mm at a rolling reduction of 73%, and heating was then performed to set the average heating rate in a range of 680 to 750° C. to 2° C./sec. Next, after soaking was performed at 780° C. for 40 seconds, cooling was performed to set the average cooling rate from an annealing temperature to immersion in a galvanizing bath at a temperature of 460° C. to 7° C./sec and to set the holding time in a temperature region of 480° C. or less to 10 sec. Subsequently, after a galvanizing treatment was performed by immersion in the galvanizing bath at a temperature of 460° C., a temperature of 510° C. was maintained for 15 seconds for an alloying treatment of a plating layer, cooling was then performed to a temperature region of 300° C. or less at an average cooling rate of 25° C./sec, and temper rolling was performed at an elongation of 0.1%. In addition, the cooling rate from 300° C. to 20° C. was 10° C./sec.

From the steel sheet thus obtained, a JIS No. 5 test piece for tensile test was formed, and a tensile test (in accordance with JIS Z2241) was carried out. In addition, stretch flangeability was evaluated by a hole expanding test in accordance with Japan Iron and Steel Federation specification JFST1001. That is, after making a hole by punching in the 100 mm length square specimen using a punch with the diameter of 10 mm and a die with the diameter of 10.2 mm (clearance: 13%), the hole was expanded until a crack penetrates the steel sheet in the thickness direction using a cone punch with the point angle of 60°. Specimens were located burrs side of the specimen to be outside during expanding. The initial hole diameter (mm) was represented by $d_0$, the hole diameter (mm) at which the crack was generated was represented by d, and the hole expanding ratio λ was obtained by the following formula: $\lambda(\%)=\{(d-d_0)/d_0\}\times 100$.

As shown in FIGS. 1 and 2, in steel in which the amount of Mn is relatively decreased such as 1.6%, since hardenability is improved by addition of P, the microstructure primarily composed of ferrite and martensite or retained γ is formed, and the second phase is uniformly dispersed. Hence, YP is significantly decreased and the hole expanding ratio λ is also significantly increased. When the amount of P is 0.015% to 0.050%, YP is decreased to 220 MPa or less, TS×λ≥38,000 (MPa·%) holds, and a high λ of 90% or more can be obtained. Since both TS and λ are increased by addition of P, TS×λ is significantly increased thereby. On the other hand, in steel in which large amounts of Mn and Mo are added, although λ is high, YP is high. In addition, in steel in which a large amount of Cr is added, YP is low, and λ is high. However, since the amount of Cr is large, the corrosion resistance is considerably degraded.

To obtain the effects, the decrease in YP, the improvement in stretch flangeability, and the improvement in corrosion resistance, at least 0.015% or more of P must be added. However, more than 0.050% of P is added, the hardenability improvement effect, the uniform microstructure formation, and the coarsening effect are saturated. In addition, the solid solution strengthening amount is excessively increased so that a low YP cannot be obtained. Further, when more than 0.050% of P is added, an alloying reaction between steel and a plating layer is considerably delayed, and the powdering resistance is degraded. In addition, the weldability is also degraded. Therefore, the amount of P is 0.050% or less.

B: 0.005% or less

B functions to uniformly coarsen ferrite grains and martensite and suppress generation of pearlite by improving hardenability. Hence, when Mn is replaced with B while a predetermined amount of [Mneq] is ensured, while high stretch flangeability is ensured, a decrease in YP can be performed. However, if more than 0.005% of B is added, casting and rolling properties are remarkably degraded. Therefore, B in an amount of 0.005% or less is preferably added. To further improve the effect of decreasing YP by addition of B, 0.0002% or more of B is preferably added, and more than 0.0010% thereof is more preferably added.

$$([\%\ Mn]+3.3[\%\ Mo])/(1.3[\%\ Cr]+8[\%\ P]+150B^*)<3.5$$

To simultaneously obtain an extremely low YP and high stretch flangeability, in addition to appropriate control of the Mn equivalent and the amounts of Mn and Mo, the composition ratio between elements such as Mn and/or Mo which refine the second phase and ferrite grains and elements such as Cr, P, and/or B which coarsely disperse the second phase must be controlled in a predetermined range. Then the microstructure in which the second phase is dispersed at the triple points of the ferrite grain boundaries can be obtained and low YP can be attained maintaining high stretch-flangeability.

Figure 3:
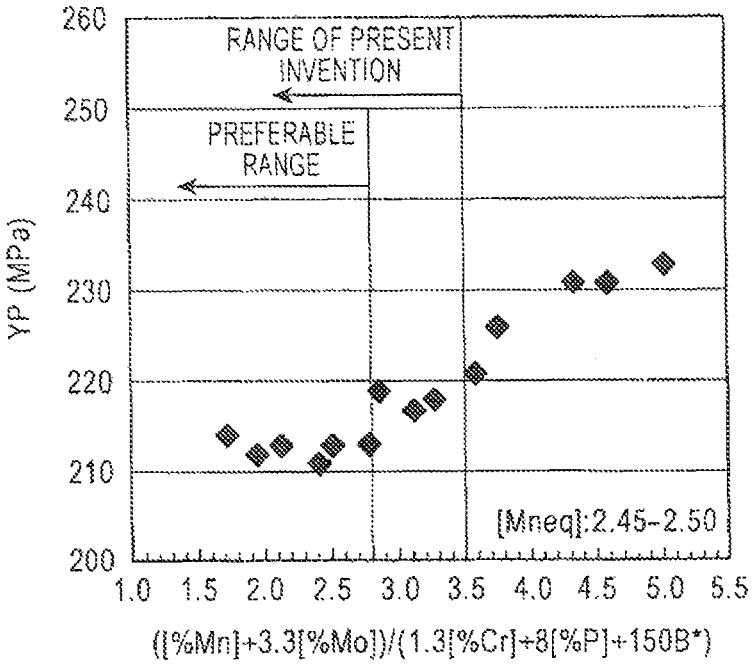
FIG. 3 is a graph showing the relationship between YP and ([% Mn]+3.3[% Mo])/(1.3[% Cr]+8[% P]+150B*).

FIG. 3 is a graph showing the results obtained by investigation on the relationship between YP and ([% Mn]+3.3[% Mo])/(1.3[% Cr]+8[% P]+150B*) of steel in which the amount of Mn and the amounts of P, Cr, and B are balanced so that [Mneq] is constant in a range of 2.50 to 2.55, using the steel containing 0.027% of C, 0.01% of Si, 1.5% to 2.2% of Mn, 0.002% to 0.048% of P, 0.003% of S, 0.06% of sol. Al, 0.15% to 0.33% of Cr, 0.003% of N, 0 to 0.0016% of B, 0% of Ti, 0.01% of Mo, and 0.01% of V. The method for manufacturing a sample and the evaluation method of YP are the same as those described above (in the case of FIGS. 1 and 2). Accordingly, when ([% Mn]+3.3[% Mo])/(1.3[% Cr]+8[% P]+150B*) is less than 3.5, YP is decreased, and when it is less than 2.8, a lower YP is obtained. In addition, the above each steel has a strength which satisfies TS≥440 MPa.

To more clearly define the appropriate ranges of [Mneq], [% Mn]+3.3[% Mo], and ([% Mn]+3.3[% Mo])/(1.3[% Cr]+8[% P]+150B*), mechanical properties of steel in which chemical compositions of Mn, P, Cr, and B were widely changed were investigated. The chemical composition of a sample included 0.022% to 0.030% of C, 0.1% of Si, 1.36% to 2.17% of Mn, 0.001% to 0.042% of P, 0.008% of S, 0.06% of sol. Al, 0.003% of N, 0% to 0.0018% of B, 0.20% to 0.38% of Cr, 0.01% of Mo, 0.01% of V, and 0% to 0.005% of Ti, and the amount of C was adjusted so that the volume fraction of the second phase was set almost constant in a range of approximately 4% to 5%. A method for manufacturing samples is the same as that described above.

Figure 4:
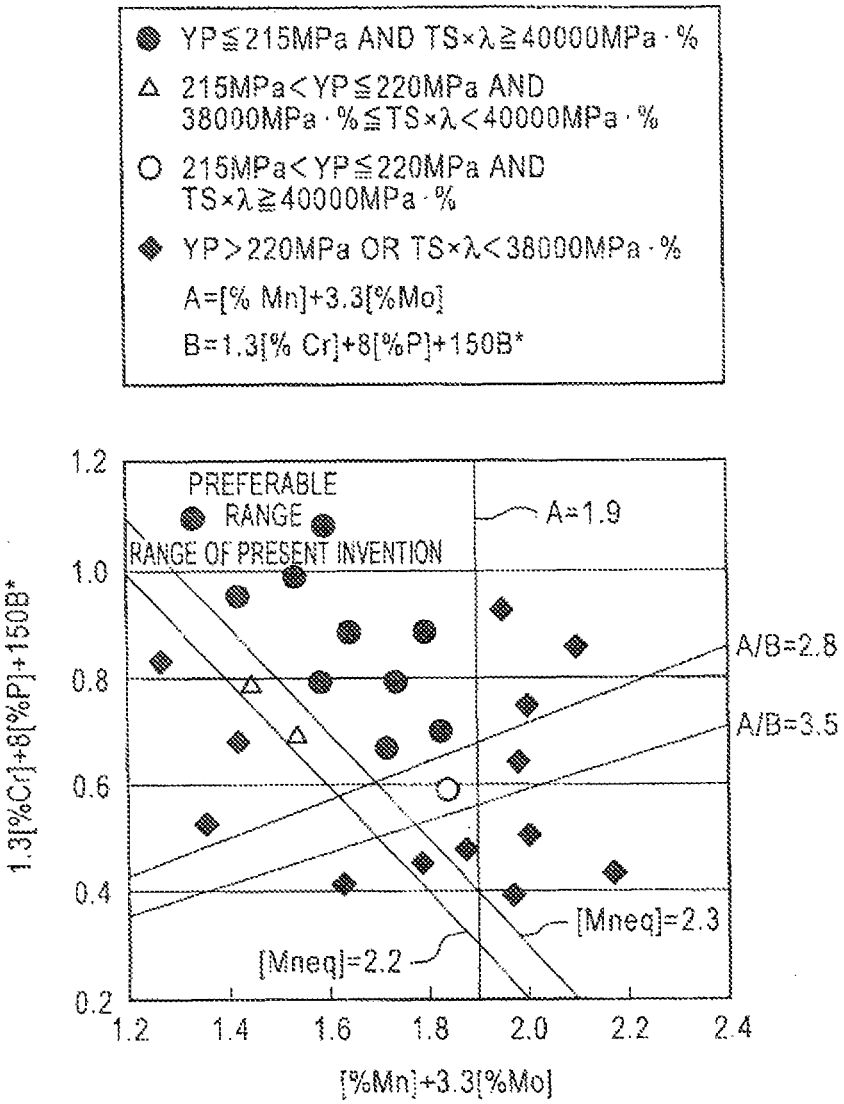
FIG. 4 is a graph showing the relationship among YP, TS×λ, [% Mn]+3.3[% Mo], and 1.3[% Cr]+8[% P]+150B*.

The obtained results are shown in FIG. 4. In FIG. 4, a steel sheet in which YP≤215 MPa and TS×λ≥40,000 (MPa·%) is shown by ●, a steel sheet in which 215 MPa<YP≤220 MPa and TS×λ≥40,000 (MPa·%) is shown by ○, and a steel sheet in which 215 MPa<YP≤220 MPa and 38,000 (MPa·%)≤TS×λ<40,000 (MPa·%) is shown by Δ. In addition, a steel sheet in which YP>220 MPa or TS×λ<38,000 (MPa·%), which does not satisfy the above properties, is shown by ◆.

Accordingly, it is found that when [Mneq] is 2.2 or more, [% Mn]+3.3[% Mo] is 1.9 or less, and ([% Mn]+3.3[% Mo])/(1.3[% Cr]+8[% P]+150B*) is less than 3.5, a low YP and a high TS×λ can be simultaneously obtained. Furthermore, when [Mneq] is 2.3 or more, TS×λ is further improved, and when ([% Mn]+3.3[% Mo])/(1.3[% Cr]+8[% P]+150B*) is less than 2.8, YP is further decreased, so that a significantly low YP and high TS×λ can be simultaneously obtained. The steel sheet as described above has the microstructure composed of ferrite as a predominant microstructure and martensite, and the generation amounts of pearlite and bainite are decreased. In addition, ferrite grains are uniform and coarse, and martensite is uniformly dispersed mainly at the triple points of the ferrite grains. As described above, [% Mn]+3.3[% Mo] is set to 1.9 or less. In addition, ([% Mn]+3.3[% Mo])/(1.3[% Cr]+8[% P]+150B*) is less than 3.5 and more preferably less than 2.8.

C: more than 0.015% to less than 0.10%

C is an element necessary to ensure the volume fraction of the second phase in a predetermined amount. If the amount of C is small, the second phase is not formed, and although the hole expanding property is improved, YP is remarkably increased. To ensure the volume fraction of the second phase in a predetermined amount and to obtain sufficiently low YP, the content of C must be set to more than 0.015%. To improve the anti-aging property and further decrease YP, the amount of C is preferably set to 0.02% or more. On the other hand, if the amount of C is 0.10% or more since the volume fraction of the second phase is excessively increased, YP is increased, and stretch flangeability is also degraded. In addition, weldability is also degraded. Therefore, the amount of C is set to less than 0.10%. To ensure excellent stretch flangeability while a low YP is maintained, the amount of C is preferably less than 0.060% and more preferably less than 0.040%.

Si: 0.5% or less

Si is added in a small amount because it has an effect of improving surface quality by delaying scale generation in hot rolling, an effect of appropriately delaying an alloying reaction between steel and zinc layer in a plating bath or in an alloying treatment, and an effect of uniformly coarsening microstructures of a steel sheet. However, when more than 0.5% of Si is added, since the quality of plating appearance is degraded, a steel sheet thus obtained is difficult to be applied to exposure panels, and YP is also increased. Hence, the amount of Si is 0.5% or less. To further improve the surface quality and decrease YP, the amount of Si is preferably 0.3% or less and more preferably less than 0.2%. Si is an element which can be arbitrarily added, and the lower limit thereof is not specified (0% of Si is included). However, from the points described above, 0.01% or more of Si is preferably added, and 0.02% or more thereof is more preferably added.

S: 0.03% or less

When an appropriate amount of S is contained, descaling properties of a primary scale of slab can be improved, and the quality of plating appearance can also be improve. Hence, S can be contained. However, if the content of S is high, the amount of MnS precipitated in steel is excessively increased, and as a result, the elongation and the stretch flangeability of a steel sheet are degraded. In addition, hot ductility is degraded when a slab is hot-rolled, and surface defects are liable to be generated. Furthermore, the corrosion resistance is slightly degraded. Hence, the amount of S is 0.03% or less. To improve the stretch flangeability and corrosion resistance, the amount of S is preferably 0.02% or less, more preferably 0.01% or less, and even more preferably 0.002% or less.

sol. Al: 0.01% to 0.5%

Al is added to promote the hardenability improvement effect of B by fixing N, improve the anti-aging property, and improve the surface quality by decreasing inclusions. To improve the hardenability improvement effect of B and the anti-aging property, the content of sol. Al is 0.01% or more. To further improve the effects described above, the content of sol. Al is preferably 0.015% or more and more preferably 0.04% or more. On the other hand, even if more than 0.5% of sol. Al is added, the effect of remaining solute B and the effect of improving the anti-aging property are saturated, and the cost is unnecessarily increased. In addition, the casting property is degraded. Hence, the surface quality is degraded. For this reason, the content of sol. Al is 0.5% or less. To ensure excellent surface quality, the content of sol. Al is preferably less than 0.2%.

N: 0.005% or less

N is an element which forms nitrides such as BN, AlN, and TiN, in steel and has an adverse influence of eliminating the effect of B, which improves the stretch flangeability while YP is decreased, through the formation of BN. In addition, fine AlN is formed to degrade the grain growth, and YP is increased. Furthermore, when solute N remains, the anti-aging property is degraded. From the points described above, the content of N must be strictly controlled. When the content of N is more than 0.005%, besides an increase in YP, the anti-aging property is degraded, and the applicability to exposure panels becomes insufficient. As described above, the content of N is 0.005% or less. To further decrease YP by decreasing the amount of precipitated AlN, the content of N is preferably 0.004% or less.

Ti: less than 0.020%

Ti is an element improving the hardenability of B by fixing N, improving the anti-aging property, and improving casting property. Hence, Ti can be arbitrarily added to auxiliary obtain the effects described above. However, when the content thereof is increased, fine precipitates such as TiC and Ti(C, N), are formed in steel to considerably increase YP, and TiC is generated during cooling after annealing to decrease BH. Hence, when Ti is added, the content thereof must be controlled in an appropriate range. When the content of Ti is 0.020% or more, YP is remarkably increased. Therefore, the content of Ti is less than 0.020%. Ti is an element which can be arbitrarily added, and the lower limit thereof is not specified (0% of Ti is included). However, to obtain the hardenability improvement effect by fixing N through precipitation of TiN, the content of Ti is preferably set to 0.002% or more, and to obtain a low YP by suppressing the precipitation of TiC, the content of Ti is preferably less than 0.010%.

V: 0.4% or less

V is an element which improves hardenability, and since the influence thereof on YP and stretch flangeability is small, and a function of degrading plating quality and corrosion resistance is also small, V can be used as alternatives of Mn or Cr. In view of the above point, 0.002% or more of V is preferably added, and 0.01% or more thereof is more preferable. However, more than 0.4% of V is added, the cost is considerably increased. Hence, 0.4% or less of V is preferably added.

Although the balance is iron and inevitable impurities, at least one another element in a predetermined amount can be further contained.

At least one of the following Nb, W, and Zr may be contained.

Nb: less than 0.02%

Since Nb has a function to strengthen a steel sheet by precipitating NbC and Nb (C, N) as well as a function to refine the microstructure, Nb can be added to increase the strength. From the points described above, 0.002% or more of Nb is preferably added, and 0.005% or more thereof is more preferably added. However, since YP is remarkably increased when 0.02% or more of Nb is added, less than 0.02% thereof is preferably added.

W: 0.15% or less

W can be used as a hardening element and a precipitation strengthening element. From the point described above, 0.002% or more of W is preferably added, and 0.005% or more thereof is more preferable. However, when the amount is excessive, since YP is increased, 0.15% or less of W is preferably added.

Zr: 0.1% or less

As in the case described above, Zr can be also used as a hardening element and a precipitation strengthening element. From the point described above, 0.002% or more of Zr is preferably added, and 0.005% or more thereof is more preferable. However, when the amount is excessive, since YP is increased, 0.1% or less of Zr is preferably added.

At least one of the following Cu, Ni, Ca, Ce, La, and Mg may be contained.

Cu: 0.5% or less

Since slightly improving the corrosion resistance, Cu is preferably added to improve corrosion resistance. In addition, Cu is an element to be mixed in when scrap is used as a raw material, and when Cu is allowed to be mixed in, recycling materials can be utilized as raw material resources so that the manufacturing cost can be reduced. To improve the corrosion resistance, 0.01% or more of Cu is preferably added, and 0.03% or more thereof is more preferably added. However, when the content is excessively high, surface defects are liable to be generated thereby. Hence, 0.5% or less of Cu is preferably added.

Ni: 0.5% or less

Ni is an element that also improves corrosion resistance. In addition, Ni also decreases surface defects which are easy to be generated when Cu is contained. Therefore, to improve the surface quality while the corrosion resistance is improved, 0.01% or more of Ni is preferably added, and 0.02% or more thereof is more preferably added. However, when the amount of Ni is excessively large, since scale formation in a heating furnace unevenly occurs, surface defects are generated thereby, and the cost is also considerably increased. Therefore, the content of Ni is 0.5% or less.

Ca: 0.01% or less

Ca fixes S in steel in the form of CaS, increases pH in a corrosion product, and improves corrosion resistance of peripheries of hemmed portions and spot welded portions. In addition, Ca improves stretch-flangeability by suppressing MnS, which degrades the stretch flangeability, by forming CaS. From the points described above, 0.0005% or more of Ca is preferably added. However, since Ca in the form of an oxide is liable to float up to the surface in molten steel and is easily separated from the molten steel, a large amount of Ca is difficult to remain in steel. Therefore, the content of Ca is 0.01% or less.

Ce: 0.01% or less

Ce can be added to fix S in steel and improve stretch flangeability and corrosion resistance. From the point described above, 0.0005% or more of Ce is preferably added. However, since Ce is an expensive element, when a large amount thereof is added, the cost is increased. Hence, 0.01% or less of Ce is preferably added.

La: 0.01% or less

La can be added to fix S in steel and improve stretch flangeability and corrosion resistance. From the point described above, 0.0005% or more of La is preferably added. However, since La is an expensive element, when a large amount thereof is added, the cost is increased. Hence, 0.01% or less of La is preferably added.

Mg: 0.01% or less

Since Mg finely disperses oxides and forms a uniform microstructure, Mg can be added. From the point described above, 0.0005% or more of Mg is preferably added. However, when the content of Mg is high, the surface quality is degraded. Hence, 0.01% or less thereof is preferably added.

At least one of the following Sn and Sb may be contained.

Sn: 0.2% or less

Sn is preferably added to suppress nitridation or oxidation of the steel sheet surface or to suppress decarburization and deboronization in a region of several tens of micrometers of a steel sheet surface layer generated by oxidation. These effects improve fatigue property, anti-aging property, surface quality and the like. To suppress nitridation and oxidation, 0.002% or more of Sn is preferably added, and 0.005% or more thereof is more preferably added. However, when the content is more than 0.2%, an increase in YP and degradation in toughness occur. Hence, 0.2% or less of Sn is preferably added.

Sb: 0.2% or less

As in the case of Sn, Sb is also preferably added to suppress nitridation or oxidation of a steel sheet surface or suppress decarburization and deboronization in a region of several tens of micrometers of a steel sheet surface layer generated by oxidation. Since the nitridation and oxidation are suppressed as described above, a decrease in amount of martensite generated in the steel sheet surface layer is prevented and/or degradation in hardenability caused by decrease in the amount of B is prevented, so that the fatigue properties and the anti-aging property are improved. In addition, the quality of plating appearance can be improved by improving galvanizing wettability. To suppress nitridation and oxidation, 0.002% or more of Sb is preferably added, and 0.005% or more thereof is more preferably added. However, when the content is more than 0.2%, an increase in YP and degradation in toughness occur. Hence, 0.2% or less of Sb is preferably added.

2) microstructure

The steel sheet microstructure is primarily composed of ferrite, martensite, a small amount of retained γ, pearlite, and bainite, and in addition, a small amount of carbides. First, a method for measuring these microstructural forms will be described.

The volume fraction of the second phase was obtained such that after an L cross-section (vertical cross-section parallel to a rolling direction) of a steel sheet was etched using a nital solution after polishing, 10 fields of view at the position of one-fourth thickness of the steel sheet were observed by SEM at a magnification of 4,000 times, and microstructural photographs taken thereby were image-analyzed to measure the area ratio of the second phase. That is, since the structural form of the steel sheet in the rolling direction and that in the direction perpendicular thereto were not so much different from each other, and the volume fractions measured in the two directions were approximately equal to each other, in this case, the volume fraction of the second phase measured using the L cross-section surface was regarded as the volume fraction of the second phase.

In the structural photograph, a region having a slightly black contrast indicated ferrite, a region in which carbides having a lamella or a dot sequence shape was regarded as pearlite or bainite, and grains having a white contrast were regarded as martensite or retained γ. The volume fraction of martensite and retained γ was obtained by measuring the area ratio of this region having a white contrast. In addition, minute dot grains having a diameter of 0.4 μm or less observed on a SEM photograph were primarily composed of carbides which were identified by TEM observation, and since being very small amount, these area ratios were regarded not to have significant influences on the material properties. Hence, the grains having a grain diameter of 0.4 μm or less were excluded from the evaluation of the volume fraction. The volume fractions were calculated for a microstructure containing grains with white contrast that is mainly a martensite and contains a slight amount of retained γ, and a microstructure containing grains with lamellar or dotted line-like carbides that are pearlite and bainite. The volume fraction of the second phase indicates the total amount of these microstructures. Among the second phase grains as described above, grains in contact with at least three ferrite grain boundaries were regarded as second phase grains present at the triple points of the ferrite grain boundaries, and the volume fraction thereof was obtained. In addition, in the case in which the second phase grains were present adjacent to each other, when a contact portion therebetween had the same width as that of the grain boundary, the second phase grains were separately counted, and when the contact portion therebetween was larger than the width of the grain boundary, that is, when the second phase grains were in contact with each other to have a certain contact width therebetween, the second phase grains were counted as one grain.

By using a Kα X-ray source with a Co target, the volume fraction of retained γ was obtained from the integrated intensity ratio between the {200}, {211}, and {220} planes of α and the {200}, {220}, and {311} planes of γ by X-ray diffraction at the position of one-fourth thickness of the steel sheet. The volume fraction of martensite was obtained by subtracting the volume fraction of retained γ obtained by X-ray diffraction from the volume fraction of martensite and retained γ obtained by the above SEM observation.

Volume fraction of second phase: 2% to 12%

To obtain a low YP, the volume fraction of the second phase must be 2% or more. However, if the volume fraction of the second phase is more than 12%, as YP is increased, the stretch flangeability is degraded. Therefore, the volume fraction of the second phase is 2% to 12%. To obtain a lower YP and more excellent stretch flangeability, the volume fraction of the second phase is preferably 10% or less, more preferably 8% or less, and even more preferably 6% or less.

Volume fraction of martensite: 1% to 10%

To obtain a low YP, the volume fraction of martensite must be set to 1% or more. However, when the volume fraction of martensite is more than 10%, as YP is increased, the stretch flangeability is degraded. Therefore, the volume fraction of martensite is 1% to 10%. To obtain a lower YP and more excellent stretch flangeability, the volume fraction of martensite is preferably 8% or less and more preferably 6% or less.

Volume fraction of retained γ: 0% to 5%

0% to 5% of retained γ can be contained. That is, since the chemical composition of steel is appropriately controlled, and a heating rate, a cooling rate, and a holding time at 480° C. or less in a CGL are appropriately controlled, retained γ is coarsely generated primarily at the triple points of the grain boundaries. In addition, retained γ is soft as compared with martensite and bainite and has no plastic strain which is formed in the periphery of martensite. Hence, it became clear that when the volume fraction of retained γ formed in this steel was 5% or less, an increase in YP hardly occurred. However, if the volume fraction of retained γ is more than 5%, as YP is slightly increased, the stretch flangeability is degraded. Therefore, the volume fraction of retained γ is set in a range of 0% to 5%. To improve stretch flangeability, the volume fraction of retained γ is preferably 4% or less and more preferably 3% or less.

Ratio of total volume fraction of martensite and retained γ to volume fraction of second phase: 70% or more When [Mneq] is not appropriately controlled in the heat cycles of CGL in which slow cooling is performed after annealing, since fine pearlite is generated adjacent to martensite, the stretch flangeability is considerably degraded, and since bainite is generated, YP is increased. To simultaneously ensure a low YP and excellent stretch flangeability by sufficiently suppressing generation of pearlite and bainite, the ratio of the total volume fraction of martensite and retained γ to the volume fraction of the second phase must be set to 70% or more.

Ratio of volume fraction of second phase present at grain boundary triple points to that of the second phase: 50% or more To sufficiently decrease YP while excellent stretch flangeability is maintained, in addition to control of the type of second phase and volume fraction thereof, the positions at which the second phase grains are present must be appropriately controlled. That is, even between steel sheets which have the same volume fraction of the second phase and the same ratio of the volume fraction of martensite and retained γ to the volume fraction of the second phase, a steel sheet in which the second phase grains are fine and are non-uniformly generated has a high YP. In addition, when the second phase is non-uniformly generated, stretch flangeability is degraded. On the other hand, we found that in a steel sheet in which the second phase grains are uniformly and coarsely dispersed primarily at the grain boundary triple points, YP can be decreased while high stretch flangeability is maintained. In addition, we also found that to obtain a low YP and high stretch flangeability as described above, the ratio of the volume fraction of the second phase present at the grain boundary triple points to that of the second phase may be controlled to be 50% or more. That is, the sites in which the second phases exist are assumed to be in the ferrite grains or at the grain boundaries, and the second phases generally tend to select energetically ferrite grain boundaries. In general, at least 80% of the second phase is precipitated in the ferrite grain boundaries. Accordingly, the second phase grains are likely to be connected to each other at the ferrite grain boundaries so that the second phase grains are liable to be non-uniformly dispersed. However, when the steel composition and the annealing conditions are appropriately controlled, the second phase grains can be dispersed at the grain boundary triple points among the ferrite grain boundaries. In this case, the second phase grains are uniformly dispersed. When the microstructural form is controlled as described above, while the second phase grains are coarsely dispersed, the number of portions at which the second phase grains are connected to each other can be decreased so that while YP is decreased, high stretch flangeability can be maintained. Although the reason YP is decreased is not clearly understood, it is believed that since spaces between martensite grains are sufficiently ensured when the second phase grains are uniformly and coarsely dispersed, deformation from the periphery of martensite is likely to occur. Therefore, the ratio of the volume fraction of the second phase present at the grain boundary triple points to the volume fraction of the second phase is 50% or more.

The microstructural form as described above can be obtained when the composition ranges of Mn, Mo, Cr, P, and B, and the like are appropriately controlled, and also for example, when the heating rate in annealing is appropriately controlled.

3) Manufacturing Conditions

The steel sheet can be manufactured, as described above, by a method comprising the steps of: performing hot rolling and cold rolling of a steel slab having the chemical composition described above; then performing heating in a continuous galvanizing line (CGL) in a temperature range of 680° C. to 750° C. at an average heating rate of less than 5.0° C./sec; subsequently performing annealing at an annealing temperature in a range of 750 to 830° C.; performing cooling at an average cooling rate from the annealing temperature to immersion in a galvanizing bath of 2° C. to 30° C./sec and at a holding time in a temperature region of 480° C. or less to 30 seconds or less; then performing galvanizing by the immersion in the galvanizing bath; and performing cooling to 300° C. or less at an average cooling rate of 5° C. to 100° C./sec after galvanizing, or further performing an alloying treatment after galvanizing, and performing cooling to 300° C. or less at an average cooling rate of 5° C. to 100° C./sec after the alloying treatment.

Hot Rolling:

To hot-roll a steel slab, for example, there may be used a method for rolling a slab after heating, a method for directly rolling a slab after continuous casting without heating, and a method for rolling a slab after a heat treatment for a short period of time performed following continuous casting. The hot rolling may be performed in accordance with a common method, and for example, a slab heating temperature, a finish rolling temperature, and a coiling temperature may be set to 1,100 to 1,300° C., the $Ar_3$ point to the $Ar_3$ point+150° C., and 400° C. to 720° C., respectively. To reduce the in-plane anisotropy of the r value and improve BH, a cooling rate after hot rolling is preferably 20° C./sec or more, and the coiling temperature is preferably set to 600° C. or less.

To obtain beautiful plating surface quality for exposure use, it is preferable that a slab heating temperature be set to 1,250° C. or less, descaling be sufficiently performed to remove primary and secondary scale generated on the surface of a steel sheet, and the finish rolling temperature be set to 900° C. or less.

Cold Rolling:

In cold rolling, the cold-rolled reduction may be 50% to 85%. To improve deep drawability by improving the r value, the cold-rolled reduction is preferably 65% to 73%, and to reduce the in-plane anisotropy of the r value and YP, the cold-rolled reduction is preferably 70% to 85%.

Figure 5:
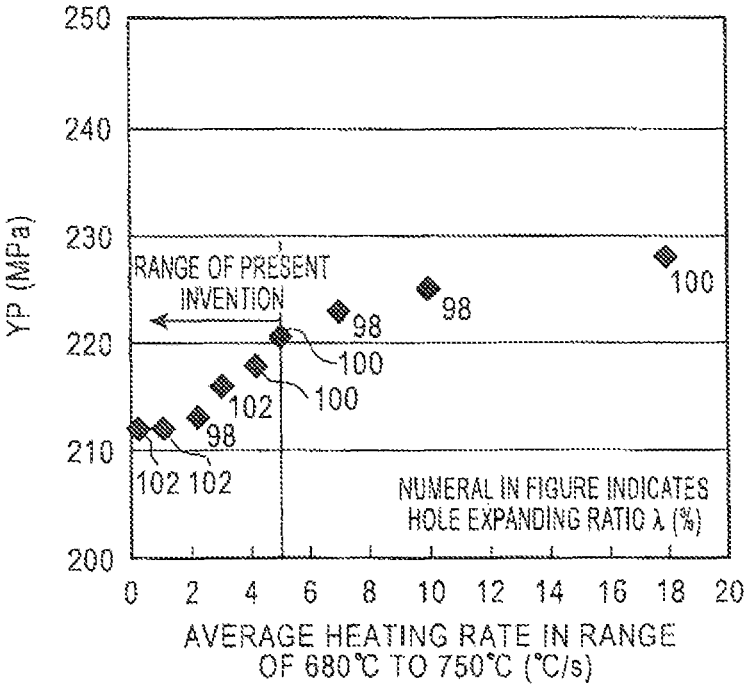
FIG. 5 is a graph showing the relationship among YP, the hole expanding ratio, and an average heating rate in a range of 680° C. to 750° C. in annealing.

CGL:

On the steel sheet processed by cold rolling, in a CGL, an annealing treatment and a plating treatment are performed or an alloying treatment is further performed after the plating treatment. To obtain a desired microstructural form which satisfies a low YP and excellent stretch flangeability at the same time, the heating rate in annealing is an important manufacturing condition which must be controlled. FIG. 5 shows the relationship among the average heating rate in a range of 680° C. to 750° C. in annealing, YP, and the hole expanding ratio of steel containing 0.028% of C, 0.01% of Si, 1.73% of Mn, 0.030% P, 0.15% of Cr, 0.06% of sol. Al, and 0.0013% of B. In addition, the conditions for forming a sample were the same as those described above (the case shown in FIGS. 1 and 2) except for the heating rate. When the heating rate in annealing is less than 5.0° C./sec, the second phase is uniformly and coarsely dispersed, and YP is significantly decreased. In addition, in the case described above, a high hole expanding ratio is maintained. That is, when the heating rate is appropriately controlled, a low YP and high stretch flangeability can be obtained at the same time. The reason the heating rate in a range of 680° C. to 750° C. in annealing has significant influence on YP is that in this temperature region, recrystallization and ferrite to austenite transformation simultaneously occurs. That is, when the heating rate is fast, since the ferrite to austenite transformation progresses while recrystallization is not sufficiently completed, many γ grains are generated at the interfaces of non-recrystallized grains, and after cooling, the second phase is finely dispersed. Accordingly, the average heating rate in a range of 680° C. to 750° C. in annealing is less than 5.0° C./sec.

The annealing temperature is 750° C. to 830° C. Carbides are not sufficiently dissolved at an annealing temperature of less than 750° C., and the volume fraction of the second phase cannot be stably ensured. At an annealing temperature of more than 830° C., since pearlite and/or bainite is liable to be generated, or the amount of retained γ is excessively generated, a sufficiently low YP cannot be obtained. In general, in continuous annealing performed in a temperature region of 750° C. or more, the soaking time may be set to 20 to 200 seconds and more preferably set to 40 to 200 seconds.

After soaking, cooling is performed to set the average cooling rate from the annealing temperature to the immersion in a galvanizing bath in which the temperature is generally maintained at 450° C. to 500° C. to 2 to 30° C./sec, and to set the holding time in a temperature region of 480° C. or less in the cooling step to 30 seconds or less. Since the cooling rate is 2° C./sec or more, the generation of pearlite in a temperature region of 500° C. to 650° C. is suppressed. Hence, excellent stretch flangeability can be obtained. In addition, since the cooling rate is 30° C./sec or less, while bainite and retained γ are prevented from being excessively generated, the volume fraction of the second phase generated at places other than the grain boundary triple points is decreased, and YP can be decreased. In addition, when the holding time in a temperature region of 480° C. or less is 30 seconds or less, fine bainite, fine retained γ, and fine martensite are suppressed from being generated at the places other than the grain boundary triple points so that YP can be decreased.

Subsequently, although galvanizing is performed in a galvanizing bath, if needed, an alloying treatment can also be performed when a temperature in a region of 470° C. to 650° C. is maintained for 40 seconds or less. Although the material quality was considerably degraded when the alloying treatment as described above was performed on a conventional steel sheet in which [Mneq] was not appropriately controlled, in the steel sheet, an increase in YP is small, and good material quality can be obtained.

After galvanizing or the alloying treatment when it is performed, cooling is performed to 300° C. or less at an average cooling rate of 5° C. to 100° C./sec. If the cooling rate is lower than 5° C./sec, pearlite is generated at approximately 550° C., and bainite is generated in a temperature region of 400° C. to 450° C. so that YP is increased. If the finish cooling temperature is more than 300° C., since tempering of martensite significantly progresses, YP is increased. On the other hand, if the cooling rate is higher than 100° C./sec, self-tempering of martensite generated in continuous cooling is not sufficiently performed, martensite is excessively hardened, and the stretch flangeability is degraded. Although the cooling rate in a temperature region of less than 300° C. is not particularly specified, when cooling is performed at a cooling rate in a general range of 0.1° C. to 1,000° C./s which can be performed by a cooling line length or a cooling method of an existing annealing apparatus, desired properties can be obtained. When there is a facility which can perform an annealing and a tempering treatment, to decrease YP, an over-aging treatment can also be performed for 30 seconds to 10 minutes at a temperature of 300° C. or less.

Skin pass rolling can be performed on the galvanized steel sheet thus obtained to stabilize press-formability, by the control of the surface roughness, and the planarization of a sheet shape. In that case, to decrease YP and to increase El, a skin pass elongation is preferably 0.1% to 0.6%.

EXAMPLES

After steel of steel Nos. A to AL shown in Tables 1 and 2 was molten, continuous casting was performed thereon to form a slab having a thickness of 230 mm.

TABLE 1

(percent by mass)

| Steel No. | C | Si | Mn | P | S | sol. Al | N | Cr | Mo | Ti | V |
|---|---|---|---|---|---|---|---|---|---|---|---|
| A | 0.027 | 0.01 | 1.80 | 0.019 | 0.005 | 0.016 | 0.0021 | 0.21 | 0.01 | 0 | 0 |
| B | 0.029 | 0.02 | 1.70 | 0.022 | 0.006 | 0.028 | 0.0012 | 0.22 | 0 | 0 | 0 |
| C | 0.032 | 0.01 | 1.48 | 0.039 | 0.001 | 0.064 | 0.0029 | 0.22 | 0.01 | 0 | 0 |
| D | 0.024 | 0.02 | 1.74 | 0.042 | 0.002 | 0.024 | 0.0020 | 0.31 | 0 | 0 | 0 |
| E | 0.032 | 0.01 | 1.51 | 0.016 | 0.003 | 0.069 | 0.0031 | 0.21 | 0 | 0 | 0 |
| F | 0.018 | 0.02 | 1.71 | 0.035 | 0.005 | 0.046 | 0.0041 | 0.28 | 0.01 | 0 | 0 |
| G | 0.016 | 0.02 | 1.80 | 0.031 | 0.005 | 0.046 | 0.0041 | 0.06 | 0.01 | 0 | 0 |
| H | 0.040 | 0.01 | 1.58 | 0.034 | 0.013 | 0.072 | 0.0029 | 0.15 | 0.03 | 0 | 0 |
| I | 0.058 | 0.15 | 1.68 | 0.038 | 0.008 | 0.059 | 0.0026 | 0.12 | 0.01 | 0 | 0 |
| J | 0.094 | 0.34 | 1.64 | 0.048 | 0.002 | 0.048 | 0.0016 | 0.14 | 0.01 | 0 | 0 |
| K | 0.028 | 0.01 | 1.64 | 0.028 | 0.001 | 0.35 | 0.0020 | 0.16 | 0.01 | 0 | 0 |
| L | 0.027 | 0.01 | 1.44 | 0.032 | 0.002 | 0.030 | 0.0021 | 0.22 | 0.10 | 0.004 | 0 |
| M | 0.028 | 0.01 | 1.49 | 0.038 | 0.001 | 0.035 | 0.0030 | 0.18 | 0.02 | 0.007 | 0 |
| N | 0.022 | 0.01 | 1.52 | 0.038 | 0.002 | 0.085 | 0.0016 | 0.04 | 0.01 | 0 | 0 |
| O | 0.023 | 0.01 | 1.50 | 0.024 | 0.006 | 0.082 | 0.0035 | 0.24 | 0.02 | 0 | 0 |
| P | 0.030 | 0.01 | 1.20 | 0.024 | 0.005 | 0.079 | 0.0015 | 0.18 | 0.01 | 0 | 0.18 |
| Q | 0.023 | 0.01 | 1.51 | 0.025 | 0.010 | 0.040 | 0.0016 | 0.14 | 0.01 | 0 | 0 |
| R | 0.026 | 0.01 | 1.59 | 0.028 | 0.002 | 0.066 | 0.0020 | 0.18 | 0.01 | 0 | 0 |
| S | 0.026 | 0.01 | 1.60 | 0.026 | 0.002 | 0.088 | 0.0010 | 0.20 | 0.01 | 0 | 0 |

(percent by mass)

| Steel No. | B | B* | others | [Mneq] | (A) | (A)/(B) | Remarks |
|---|---|---|---|---|---|---|---|
| A | 0.0006 | 0.0008 | — | 2.37 | 1.83 | 3.40 | invention steel |
| B | 0.0010 | 0.0013 | — | 2.35 | 1.70 | 2.60 | invention steel |
| C | 0.0014 | 0.0020 | — | 2.42 | 1.51 | 1.67 | invention steel |
| D | 0.0005 | 0.0007 | — | 2.59 | 1.74 | 2.05 | invention steel |
| E | 0.0015 | 0.0022 | — | 2.24 | 1.51 | 2.07 | invention steel |
| F | 0 | 0.0000 | — | 2.39 | 1.74 | 2.71 | invention steel |
| G | 0.0027 | 0.0022 | — | 2.49 | 1.83 | 2.79 | invention steel |
| H | 0.0018 | 0.0022 | — | 2.48 | 1.68 | 2.11 | invention steel |
| I | 0.0018 | 0.0022 | — | 2.50 | 1.71 | 2.17 | invention steel |
| J | 0.0016 | 0.0021 | — | 2.55 | 1.67 | 1.91 | invention steel |
| K | 0.0003 | 0.0022 | — | 2.44 | 1.67 | 2.20 | invention steel |
| L | 0.0012 | 0.0022 | — | 2.64 | 1.77 | 2.03 | invention steel |
| M | 0.0011 | 0.0022 | Ce: 0.003 | 2.42 | 1.56 | 1.79 | invention steel |
| N | 0.0022 | 0.0022 | Cu: 0.18, Ni: 0.20 | 2.24 | 1.55 | 2.26 | invention steel |
| O | 0.0016 | 0.0022 | Nb: 0.005 | 2.40 | 1.57 | 1.88 | invention steel |
| P | 0.0015 | 0.0022 | Mg: 0.005 | 2.35 | 1.23 | 1.63 | invention steel |
| Q | 0.0018 | 0.0022 | Zr: 0.04, W: 0.06 | 2.26 | 1.54 | 2.17 | invention steel |
| R | 0.0014 | 0.0021 | Ca: 0.005, Sb: 0.02 | 2.39 | 1.62 | 2.12 | invention steel |
| S | 0.0012 | 0.0021 | La: 0.003 Sn: 0.01 | 2.41 | 1.03 | 2.09 | invention steel |

(A): [% Mn] + 3.3[% Mo]

(B): 1.3[% Cr] + 8[% P] + 150B*

TABLE 2

(percent by mass)

| Steel No. | C | Si | Mn | P | S | sol. Al | N | Cr | Mo | Ti | V |
|---|---|---|---|---|---|---|---|---|---|---|---|
| T | 0.035 | 0.01 | 1.48 | 0.008 | 0.006 | 0.063 | 0.0030 | 0.31 | 0 | 0 | 0 |
| U | 0.030 | 0.01 | 1.83 | 0.002 | 0.008 | 0.048 | 0.0039 | 0.30 | 0.02 | 0 | 0 |
| V | 0.027 | 0.01 | 1.58 | 0.019 | 0.009 | 0.040 | 0.0038 | 0.40 | 0 | 0 | 0 |
| W | 0.029 | 0.01 | 1.52 | 0.025 | 0.007 | 0.053 | 0.0041 | 0.60 | 0 | 0 | 0 |
| X | 0.023 | 0.01 | 2.21 | 0.032 | 0.008 | 0.034 | 0.0033 | 0.22 | 0.01 | 0 | 0 |
| Y | 0.038 | 0.01 | 0.50 | 0.045 | 0.008 | 0.059 | 0.0033 | 0.31 | 0.14 | 0 | 0 |
| Z | 0.015 | 0.01 | 1.98 | 0.022 | 0.012 | 0.020 | 0.0022 | 0.18 | 0.01 | 0 | 0 |
| AA | 0.034 | 0.01 | 2.05 | 0.022 | 0.010 | 0.045 | 0.0050 | 0.17 | 0.01 | 0 | 0 |
| AB | 0.081 | 0.01 | 2.09 | 0.028 | 0.009 | 0.040 | 0.0029 | 0.17 | 0.01 | 0 | 0 |
| AC | 0.025 | 0.01 | 1.68 | 0.059 | 0.004 | 0.065 | 0.0033 | 0.20 | 0.01 | 0 | 0 |
| AD | 0.025 | 0.01 | 1.48 | 0.012 | 0.005 | 0.040 | 0.0028 | 0.01 | 0.18 | 0 | 0 |
| AE | 0.027 | 0.01 | 1.72 | 0.030 | 0.002 | 0.059 | 0.0022 | 0.16 | 0.01 | 0.025 | 0 |
| AF | 0.012 | 0.01 | 1.50 | 0.035 | 0.004 | 0.064 | 0.0022 | 0.22 | 0 | 0 | 0 |
| AG | 0.029 | 0.01 | 1.72 | 0.030 | 0.004 | 0.068 | 0.0060 | 0.10 | 0 | 0 | 0 |
| AH | 0.018 | 0 | 1.89 | 0.034 | 0.001 | 0.015 | 0.0012 | 0 | 0 | 0.002 | 0.001 |
| AI | 0.031 | 0.01 | 1.53 | 0.044 | 0.001 | 0.18 | 0.0041 | 0.02 | 0.02 | 0.003 | 0.002 |
| AJ | 0.023 | 0.01 | 1.55 | 0.028 | 0.012 | 0.070 | 0.0029 | 0.15 | 0 | 0.004 | 0.002 |
| AK | 0.019 | 0 | 1.87 | 0.027 | 0.004 | 0.061 | 0.0033 | 0 | 0 | 0.004 | 0.003 |
| AL | 0.035 | 0.01 | 1.46 | 0.037 | 0.002 | 0.049 | 0.0025 | 0.12 | 0.02 | 0.005 | 0.010 |

TABLE 2-continued (percent by mass)

| Steel No. | B | B* | others | [Mneq] | (A) | (A)/(B) | Remarks |
|---|---|---|---|---|---|---|---|
| T | 0.0005 | 0.0011 | — | 2.12 | 1.48 | 2.33 | comparative steel |
| U | 0 | 0 | — | 2.30 | 1.90 | 4.67 | comparative steel |
| V | 0.0002 | 0.0006 | — | 2.34 | 1.58 | 2.07 | comparative steel |
| W | 0 | 0 | — | 2.50 | 1.52 | 1.55 | comparative steel |
| X | 0.0005 | 0.0008 | — | 2.91 | 2.24 | 3.36 | comparative steel |
| Y | 0.0018 | 0.0022 | — | 2.06 | 0.96 | 0.88 | comparative steel |
| Z | 0.0004 | 0.0006 | — | 2.51 | 2.01 | 4.03 | comparative steel |
| AA | 0.0003 | 0.0008 | — | 2.59 | 2.08 | 4.09 | comparative steel |
| AB | 0.0003 | 0.0007 | — | 2.67 | 2.12 | 3.86 | comparative steel |
| AC | 0.0009 | 0.0016 | — | 2.68 | 1.71 | 1.78 | comparative steel |
| AD | 0.0008 | 0.0012 | — | 2.36 | 2.07 | 7.18 | comparative steel |
| AE | 0.0010 | 0.0022 | — | 2.53 | 1.75 | 2.25 | comparative steel |
| AF | 0.0009 | 0.0015 | — | 2.30 | 1.50 | 1.88 | comparative steel |
| AG | 0.0033 | 0.0022 | — | 2.42 | 1.72 | 2.46 | comparative steel |
| AH | 0.0014 | 0.0020 | Ca: 0.0005<br>Sb: 0.002 | 2.46 | 1.89 | 3.34 | invention steel |
| AI | 0.0015 | 0.0022 | Ce: 0.0005<br>Sn: 0.002 | 2.31 | 1.60 | 2.25 | invention steel |
| AJ | 0.0014 | 0.0022 | Cu: 0.01<br>Ni: 0.01 | 2.30 | 1.55 | 2.07 | invention steel |
| AK | 0.0018 | 0.0022 | Zr: 0.002<br>W: 0.002<br>Nb: 0.002 | 2.42 | 1.87 | 3.42 | invention steel |
| AL | 0.0015 | 0.0022 | Mg: 0.0005<br>La: 0.0005 | 2.33 | 1.03 | 1.95 | invention steel |

(A): [% Mn] + 3.3[% Mo]
(B): 1.3[% Cr] + 8[% P] + 150B*

After this slab was heated to 1,180° C. to 1,250° C., hot rolling was performed at a finish rolling temperature in a range of 820° C. to 900° C. Subsequently, cooling was performed to 640° C. or less at an average cooling rate of 15° C. to 35° C./sec, and coiling was performed at a coiling temperature CT of 400° C. to 640° C. The hot-rolled sheet thus obtained was processed by cold rolling at a cold-rolled reduction of 70% to 77% so that a cold-rolled sheet having a thickness of 0.8 mm was formed.

In a CGL, as shown in Tables 3 and 4, the cold-rolled sheet thus obtained was heated so that the heating rate (average heating rate) in a temperature region of 680° C. to 750° C. was 0.8° C. to 18° C./sec, annealing was performed at an annealing temperature AT for 40 seconds, and cooling was then performed at a primary cooling rate shown in Tables 3 and 4 as the average cooling rate from the annealing temperature AT to a plating bath temperature. In addition, in this process, a time from the cooling to 480° C. or less to the immersion in the plating bath was shown in Tables 3 and 4 as a holding time at 480° C. or less. Subsequently, after an alloying treatment was further performed following galvanizing which was performed by immersion in a galvanizing bath, or after galvanizing was performed when the alloying treatment was not performed thereafter, cooling was performed to 300° C. or less so that the average cooling rate from the temperature of the plating bath to 300° C. was set to a secondary cooling rate shown in Tables 3 and 4, and when the alloying treatment was performed following the galvanizing, after the alloying treatment, cooling was performed to 300° C. or less so that the average cooling rate from the alloying temperature to 300° C. was set to the secondary cooling rate shown in Tables 3 and 4. Galvanizing was performed at a bath temperature of 460° C. and an Al content in the bath of 0.13%, and alloying treatment was performed such that after immersion in the plating bath, heating was performed at 480° C. to 540° C. at an average heating rate of 15° C./sec, and the temperature was maintained for 10 to 25 seconds so that the Fe content in a plating layer was 9 to 12%. Galvanizing was performed on the two surfaces so that the galvanized amount was 45 g/m2 per one side. In addition, the cooling rate from 300° C. to 20° C. was 10° C./sec. Temper rolling at an elongation of 0.1% was performed on the galvanized steel sheet thus obtained, and samples were formed therefrom.

By the methods described above, the volume fraction of the second phase, the ratio of the total volume fraction of martensite and retained γ to the volume fraction of the second phase (ratio of martensite and retained γ in the second phase), and the ratio of the volume fraction of the second phase present at the grain boundary triple points to that of the second phase (ratio of part of the second phase present at the grain boundary triple points to the second phase) were investigated. In addition, the types of steel microstructures were identified by SEM observation. Furthermore, after JIS No. 5 test pieces were obtained in the direction perpendicular to the rolling direction, a tensile test (in accordance with JIS Z2241) was performed, and YP and TS were evaluated. In addition, by the method described above, the hole expanding ratio λ was evaluated.

Furthermore, by using model parts simulating peripheries of a hem processing portion and a spot welding portion, the corrosion resistance of each steel sheet was evaluated. That is, after 2 steel sheets thus obtained were overlapped with each other and were placed in a close contact state by spot welding, and a chemical conversion treatment and electrocoating, which simulated a painting process for a real automobile, were further performed, a corrosion test was performed under corrosion cycle conditions in accordance with SAE J2334. The thickness formed by electrocoating was set to 20 μm. After the sample was subjected to 90 corrosion cycles, a corrosion product was removed therefrom, and the thickness change was calculated from the original thickness measured beforehand as a corrosion thickness loss.

The results are shown in Tables 3 and 4.

TABLE 3

| Steel sheet No. | Steel No. | Annealing conditions: Heating rate (° C./s) | AT (° C.) | Primary cooling rate (° C./s) | Holding time at 480° C. or less (s) | Secondary cooling rate (° C./s) | Alloying treatment | Microstructure: Volume fraction of second phase (%) | Volume fraction of ferrite (%) | Volume fraction of martensite (%) | Volume fraction of retained γ (%) | Ratio of martensite and retained γ in second phase (%) |
|---|---|---|---|---|---|---|---|---|---|---|---|---|
| 1 | A | 2.0 | 770 | 5 | 12 | 25 | Yes | 3.9 | 96.1 | 2.2 | 1.1 | 85 |
| 2 | | 5.0 | 770 | 5 | 12 | 25 | Yes | 4.0 | 96.0 | 2.3 | 1.1 | 85 |
| 3 | B | 0.8 | 780 | 5 | 12 | 25 | Yes | 4.0 | 96.0 | 2.1 | 1.4 | 88 |
| 4 | | 2.0 | | 5 | 12 | 25 | Yes | 4.1 | 95.9 | 2.1 | 1.5 | 88 |
| 5 | | 4.4 | | 5 | 12 | 25 | Yes | 4.2 | 95.8 | 2.1 | 1.6 | 88 |
| 6 | | 18 | | 5 | 12 | 25 | Yes | 4.2 | 95.8 | 2.1 | 1.7 | 90 |
| 7 | | 2.2 | | 5 | 12 | 25 | No | 4.7 | 95.3 | 2.5 | 1.9 | 94 |
| 8 | | 2.2 | | 5 | 40 | 25 | Yes | 4.5 | 95.5 | 1.0 | 1.9 | 64 |
| 9 | | 2.2 | | 1 | 12 | 25 | Yes | 2.9 | 97.1 | 0 | 1.0 | 34 |
| 10 | | 2.2 | | 5 | 12 | 3 | Yes | 4.1 | 95.9 | 1.0 | 1.7 | 66 |
| 11 | | 2.2 | | 5 | 12 | 50 | Yes | 4.9 | 95.1 | 2.6 | 2.3 | 100 |
| 12 | | 2.2 | | 40 | 4 | 20 | Yes | 6.8 | 93.2 | 1.8 | 2.8 | 68 |
| 13 | | 1.5 | 820 | 5 | 10 | 35 | Yes | 5.2 | 94.8 | 1.7 | 2.5 | 81 |
| 14 | | 2.2 | 855 | 5 | 15 | 20 | Yes | 5.7 | 94.3 | 1.5 | 2.2 | 65 |
| 15 | C | 2.0 | 790 | 5 | 8 | 35 | Yes | 4.3 | 95.7 | 1.9 | 2.4 | 100 |
| 16 | D | 2.4 | 790 | 5 | 20 | 25 | Yes | 4.6 | 95.4 | 2.4 | 2.2 | 100 |
| 17 | E | 1.2 | 790 | 8 | 8 | 30 | Yes | 5.3 | 94.7 | 1.6 | 2.4 | 75 |
| 18 | F | 1.6 | 770 | 5 | 15 | 25 | Yes | 3.7 | 96.3 | 1.6 | 1.6 | 86 |
| 19 | | 4.2 | 780 | 5 | 15 | 20 | Yes | 3.7 | 96.3 | 1.7 | 1.6 | 89 |
| 20 | | 15 | 780 | 5 | 15 | 20 | Yes | 3.8 | 96.2 | 1.9 | 1.5 | 89 |
| 21 | G | 1.4 | 780 | 6 | 10 | 30 | Yes | 3.1 | 96.9 | 1.3 | 1.8 | 100 |
| 22 | H | 0.9 | 780 | 5 | 15 | 40 | Yes | 7.3 | 92.7 | 3.2 | 4.0 | 99 |
| 23 | | 3.8 | 830 | 4 | 10 | 40 | Yes | 7.4 | 92.6 | 3.1 | 4.0 | 96 |
| 24 | I | 1.2 | 780 | 5 | 8 | 25 | Yes | 9.5 | 90.5 | 5.5 | 4.0 | 100 |
| 25 | J | 1.5 | 780 | 5 | 12 | 25 | Yes | 11.5 | 88.5 | 7.4 | 4.1 | 100 |

| Steel sheet No. | Microstructure: Ratio of part of second phase present at grain boundary triple points to second phase (%) | Microstructure type | Mechanical Properties: YP (MPa) | TS (MPa) | YR (%) | λ (%) | TS × λ (MPa · %) | Corrosion: thickness loss (mm) | Remarks |
|---|---|---|---|---|---|---|---|---|---|
| 1 | 58 | F + M + γ + B | 219 | 453 | 48 | 102 | 46206 | 0.34 | invention example |
| 2 | 49 | F + M + γ + B | 226 | 456 | 50 | 99 | 45144 | 0.35 | Comparative example |
| 3 | 78 | F + M + γ + B | 210 | 455 | 46 | 105 | 47775 | 0.35 | invention example |
| 4 | 72 | F + M + γ + B | 212 | 456 | 46 | 103 | 46968 | 0.34 | invention example |
| 5 | 62 | F + M + γ + B | 215 | 457 | 47 | 101 | 46157 | 0.35 | invention example |
| 6 | 48 | F + M + γ + B | 228 | 453 | 50 | 98 | 44394 | 0.35 | Comparative example |
| 7 | 84 | F + M + γ + B | 214 | 460 | 47 | 95 | 43700 | 0.35 | invention example |
| 8 | 60 | F + M + γ + B | 270 | 445 | 61 | 110 | 48950 | 0.35 | Comparative example |
| 9 | 64 | F + γ + P + B | 285 | 421 | 68 | 78 | 32838 | 0.35 | Comparative example |
| 10 | 62 | F + M + γ + P + B | 269 | 448 | 60 | 68 | 30464 | 0.35 | Comparative example |
| 11 | 76 | F + M + γ | 216 | 462 | 47 | 102 | 47124 | 0.34 | invention example |
| 12 | 54 | F + M + γ + B | 235 | 468 | 50 | 105 | 49140 | 0.34 | Comparative example |
| 13 | 68 | F + M + γ + B | 219 | 464 | 47 | 100 | 46400 | 0.35 | invention example |
| 14 | 65 | F + M + γ + B | 232 | 461 | 50 | 100 | 46100 | 0.33 | Comparative example |
| 15 | 95 | F + M + γ | 204 | 458 | 45 | 116 | 53128 | 0.33 | invention example |
| 16 | 92 | F + M + γ | 214 | 455 | 47 | 110 | 50050 | 0.39 | invention example |
| 17 | 76 | F + M + γ + P + B | 220 | 453 | 49 | 85 | 38505 | 0.36 | invention example |
| 18 | 74 | F + M + γ + B | 214 | 457 | 47 | 111 | 50727 | 0.36 | invention example |
| 19 | 64 | F + M + γ + B | 219 | 460 | 48 | 108 | 49680 | 0.34 | invention example |
| 20 | 49 | F + M + γ + B | 232 | 468 | 50 | 108 | 50544 | 0.36 | Comparative example |
| 21 | 68 | F + M + γ | 216 | 438 | 49 | 114 | 49932 | 0.28 | invention example |
| 22 | 82 | F + M + γ + B | 221 | 534 | 41 | 88 | 46992 | 0.29 | invention example |
| 23 | 79 | F + M + γ + B | 223 | 539 | 41 | 85 | 45815 | 0.30 | invention example |
| 24 | 84 | F + M + γ | 230 | 549 | 42 | 80 | 43920 | 0.29 | invention example |
| 25 | 94 | F + M + γ | 269 | 592 | 45 | 72 | 42624 | 0.27 | invention example |

F: ferrite, M: martensite, γ: retained γ, P: pearlite, B: bainite

TABLE 4

| Steel sheet No. | Steel No. | Annealing conditions: Heating rate (° C./s) | AT (° C.) | Primary cooling rate (° C./s) | Holding time at 480° C. or less (s) | Secondary cooling rate (° C./s) | Alloying treatment | Microstructure: Volume fraction of second phase (%) | Volume fraction of ferrite (%) | Volume fraction of martensite (%) | Volume fraction of retained γ (%) | Ratio of martensite and retained γ in second phase (%) |
|---|---|---|---|---|---|---|---|---|---|---|---|---|
| 26 | K | 2.8 | 790 | 5 | 8 | 25 | Yes | 4.3 | 95.7 | 2.1 | 2.0 | 95 |
| 27 | L | 1.0 | 780 | 4 | 12 | 25 | Yes | 4.8 | 95.2 | 2.7 | 2.1 | 100 |
| 28 | M | 1.2 | 780 | 10 | 5 | 25 | Yes | 5.1 | 94.9 | 1.8 | 2.9 | 92 |
| 29 | N | 1.5 | 770 | 7 | 18 | 25 | Yes | 4.5 | 95.5 | 1.3 | 2.4 | 82 |
| 30 | O | 1.5 | 780 | 6 | 8 | 25 | Yes | 4.1 | 95.9 | 2.0 | 1.9 | 95 |
| 31 | P | 1.0 | 780 | 5 | 8 | 25 | Yes | 4.2 | 95.8 | 1.8 | 1.8 | 86 |
| 32 | Q | 1.0 | 780 | 5 | 12 | 25 | Yes | 4.3 | 95.7 | 1.4 | 2.0 | 79 |
| 33 | R | 1.0 | 780 | 5 | 12 | 25 | Yes | 4.4 | 95.6 | 2.0 | 1.8 | 86 |
| 34 | S | 1.5 | 780 | 5 | 10 | 25 | Yes | 4.4 | 95.6 | 2.2 | 1.8 | 91 |
| 35 | T | 5.2 | 780 | 5 | 10 | 25 | Yes | 3.2 | 96.8 | 1.0 | 0.9 | 59 |
| 36 | U | 2.8 | 780 | 5 | 12 | 25 | Yes | 4.8 | 95.2 | 2.8 | 0.9 | 77 |
| 37 | | 5.2 | 780 | 5 | 12 | 25 | Yes | 4.9 | 95.1 | 3.0 | 0.9 | 80 |
| 38 | | 10.0 | 780 | 5 | 12 | 25 | Yes | 5.0 | 95.0 | 3.2 | 0.9 | 82 |
| 39 | V | 5.0 | 780 | 5 | 15 | 25 | Yes | 4.1 | 95.9 | 2.5 | 0.9 | 83 |
| 40 | W | 5.0 | 780 | 5 | 12 | 25 | Yes | 4.4 | 95.6 | 3.5 | 0.9 | 100 |
| 41 | X | 2.6 | 780 | 5 | 15 | 25 | Yes | 4.8 | 95.2 | 3.9 | 0.9 | 100 |
| 42 | | 5.0 | 780 | 5 | 15 | 25 | Yes | 4.9 | 95.1 | 4.0 | 0.9 | 100 |
| 43 | Y | 5.2 | 780 | 5 | 15 | 25 | Yes | 4.1 | 95.9 | 1.0 | 1.2 | 54 |
| 44 | Z | 5.2 | 780 | 5 | 12 | 25 | Yes | 2.9 | 97.1 | 2.0 | 0.9 | 100 |
| 45 | AA | 5.2 | 780 | 5 | 12 | 25 | Yes | 7.1 | 92.9 | 5.3 | 1.8 | 100 |
| 46 | AB | 2.0 | 780 | 5 | 12 | 25 | Yes | 11.9 | 88.1 | 9.5 | 2.4 | 100 |
| 47 | | 5.0 | 780 | 5 | 12 | 25 | Yes | 12.0 | 88.0 | 9.6 | 2.4 | 100 |
| 48 | AC | 5.4 | 780 | 5 | 12 | 25 | Yes | 4.5 | 95.5 | 2.5 | 2.0 | 100 |
| 49 | AD | 5.2 | 780 | 5 | 12 | 25 | Yes | 4.3 | 95.7 | 3.2 | 0.8 | 93 |
| 50 | AE | 2.0 | 780 | 5 | 10 | 25 | Yes | 4.4 | 95.6 | 2.3 | 2.1 | 100 |
| 51 | | 5.0 | 780 | 5 | 10 | 25 | Yes | 4.4 | 95.6 | 2.4 | 2.0 | 100 |
| 52 | AF | 5.0 | 780 | 4 | 12 | 25 | Yes | 0 | 100.0 | 0 | 0 | — |
| 53 | AG | 5.0 | 780 | 5 | 12 | 25 | Yes | 5.1 | 94.9 | 1.6 | 1.4 | 59 |
| 54 | AH | 1.5 | 790 | 5 | 12 | 25 | Yes | 3.5 | 96.5 | 1.7 | 1.8 | 100 |
| 55 | AI | 1.5 | 790 | 5 | 12 | 25 | Yes | 5.0 | 95.0 | 2.1 | 1.9 | 80 |
| 56 | AJ | 1.5 | 790 | 5 | 12 | 25 | Yes | 4.5 | 95.5 | 2.0 | 1.6 | 80 |
| 57 | AK | 1.5 | 800 | 5 | 12 | 25 | Yes | 3.8 | 96.2 | 1.8 | 2.0 | 100 |
| 58 | AL | 1.5 | 800 | 5 | 12 | 25 | Yes | 5.9 | 94.1 | 2.4 | 2.4 | 81 |

| Steel sheet No. | Microstructure: Ratio of part of second phase present at grain boundary triple points to second phase (%) | Microstructure type | Mechanical Properties: YP (MPa) | TS (MPa) | YR (%) | λ (%) | TS × λ (MPa · %) | Corrosion: thickness loss (mm) | Remarks |
|---|---|---|---|---|---|---|---|---|---|
| 26 | 79 | F + M + γ + B | 206 | 460 | 45 | 112 | 51520 | 0.30 | Invention example |
| 27 | 78 | F + M + γ | 219 | 460 | 48 | 106 | 48760 | 0.34 | Invention example |
| 28 | 94 | F + M + γ + B | 212 | 458 | 46 | 114 | 52212 | 0.30 | Invention example |
| 29 | 72 | F + M + γ + B | 218 | 452 | 48 | 109 | 49268 | 0.25 | Invention example |
| 30 | 80 | F + M + γ + B | 220 | 457 | 48 | 98 | 44786 | 0.36 | Invention example |
| 31 | 90 | F + M + γ + B | 220 | 459 | 48 | 100 | 45900 | 0.35 | Invention example |
| 32 | 69 | F + M + γ + B | 220 | 462 | 48 | 105 | 48510 | 0.31 | Invention example |
| 33 | 86 | F + M + γ + B | 212 | 457 | 46 | 115 | 52555 | 0.29 | Invention example |
| 34 | 86 | F + M + γ + B | 208 | 456 | 46 | 102 | 46512 | 0.30 | Invention example |
| 35 | 52 | F + M + γ + P + B | 265 | 441 | 60 | 65 | 28665 | 0.44 | Comparative example |
| 36 | 49 | F + M + γ + B | 235 | 460 | 51 | 90 | 41400 | 0.43 | Comparative example |
| 37 | 44 | F + M + γ + B | 239 | 463 | 52 | 86 | 39818 | 0.43 | Comparative example |
| 38 | 42 | F + M + γ + B | 245 | 467 | 52 | 85 | 39695 | 0.43 | Comparative example |
| 39 | 82 | F + M + γ + B | 208 | 445 | 47 | 105 | 46725 | 0.53 | Comparative example |
| 40 | 95 | F + M + γ | 200 | 449 | 45 | 109 | 48941 | 0.78 | Comparative example |
| 41 | 44 | F + M + γ | 248 | 469 | 63 | 102 | 47838 | 0.30 | Comparative example |
| 42 | 40 | F + M + γ | 261 | 475 | 55 | 99 | 47025 | 0.31 | Comparative example |
| 43 | 58 | F + M + γ + P + B | 271 | 428 | 63 | 68 | 29104 | 0.46 | Comparative example |
| 44 | 49 | F + M + γ | 231 | 436 | 53 | 112 | 48832 | 0.30 | Comparative example |
| 45 | 45 | F + M + γ | 264 | 493 | 64 | 86 | 42398 | 0.29 | Comparative example |
| 46 | 44 | F + M + γ | 314 | 594 | 63 | 64 | 38016 | 0.28 | Comparative example |
| 47 | 40 | F + M + γ | 336 | 608 | 55 | 63 | 38304 | 0.29 | Comparative example |
| 48 | 98 | F + M + γ | 234 | 470 | 50 | 98 | 46060 | 0.30 | Comparative example |
| 49 | 65 | F + M + γ + B | 235 | 468 | 50 | 95 | 44460 | 0.30 | Comparative example |
| 50 | 49 | F + M + γ | 243 | 472 | 61 | 95 | 44840 | 0.30 | Comparative example |
| 51 | 45 | F + M + γ | 254 | 178 | 63 | 91 | 43498 | 0.29 | Comparative example |
| 52 | — | F | 292 | 418 | 70 | 120 | 50160 | 0.34 | Comparative example |
| 53 | 68 | F + M + γ + B | 268 | 460 | 57 | 64 | 29440 | 0.28 | Comparative example |
| 54 | 62 | F + M + γ | 218 | 447 | 49 | 99 | 44253 | 0.22 | invention example |

TABLE 4-continued

| | | | | | | | | | |
|---|---|---|---|---|---|---|---|---|---|
| 55 | 86 | F + M + γ + B | 209 | 454 | 46 | 102 | 46308 | 0.24 | invention example |
| 56 | 95 | F + M + γ + B | 204 | 449 | 45 | 100 | 44900 | 0.30 | invention example |
| 57 | 64 | F + M + γ | 219 | 450 | 49 | 100 | 45000 | 0.30 | invention example |
| 58 | 95 | F + M + γ + B | 212 | 464 | 46 | 98 | 45472 | 0.27 | invention example |

F: ferrite, M: martensite, γ: retained γ, F: pearlite, B: bainite

Compared with conventional steel in which the contents of Cr, Mn, and P are not appropriately controlled, the corrosion thickness loss of our steel sheet is significantly decreased, and in addition, compared with steel having a low Mn equivalent, steel containing a large amount of Mn, steel containing Mo, or steel in which the heating rate in annealing is not appropriately controlled, the steel having the same TS level our example has a high hole expanding ratio as well as a low YP, that is, a low YR.

That is, conventional steel V and W containing a large amount of Cr each have a considerably large corrosion thickness loss in a range of 0.53 to 0.78 mm. Since the hole-forming resistant life of this type of steel is decreased by 1 to 2.5 years, this steel is difficult to be applied to exposure panels. In addition, in steel T, U, and Y in which although the Cr content is less than 0.40%, the content of P and Mn are not appropriately controlled, the corrosion thickness loss is slightly large, such as 0.43 to 0.46 mm. On the other hand, the corrosion thickness loss of our steel is significantly decreased to 0.22 to 0.39 mm. Although not shown in the tables, when the corrosion resistant evaluation was also performed on the conventional 340BH, its corrosion thickness loss was 0.34 to 0.37 mm. In addition, the chemical composition of this steel (conventional 340BH) was as follows: 0.002% of C, 0.01% of Si, 0.4% of Mn, 0.05% of P, 0.008% of S, 0.04% of Cr, 0.06% of sol. Al, 0.01% of Nb, 0.0018% of N, and 0.0008% of B. As described above, we found that our steel has the corrosion resistance approximately equivalent to that of the conventional steel. Among those steel sheets described above, the steel in which the amount of Cr is less than 0.30%, steel G, H, I, J, and K in which a large amount of P is added while the amount of Cr is further decreased, and steel M, R, and S in which besides decrease in amount of Cr and addition of a large amount of P, Ce, Ca, and La are collectively added also have good corrosion resistance, and in steel N in which Cu and Ni are collectively added, its corrosion resistance is particularly excellent.

In steel having improved corrosion resistance by decreasing the amount of Cr and appropriately controlling the amount of P, when the Mn equivalent, the amounts of Mn and Mo ([% Mn]+3.3[% Mo])/(1.3[% Cr]+8[% P]+150B*), and the heating rate in annealing are further appropriately controlled, generation of pearlite and/or bainite is also suppressed, the ratio of part of the second phase present at the grain boundary triple points is high, and a low YP can be obtained while high stretch flangeability is maintained. For example, steel A obtained at a heating rate of less than 5.0° C./sec in annealing has a TS: 440 MPa class and shows a low YP of 220 MPa or less, a low YR of 49% or less, and a high TS×λ (hole expanding ratio) of 38,000 MPa or more. In steel B and C, the amounts of P and B are increased while the amount of Mn is decreased, and ([% Mn]+3.3[% Mo])/(1.3[% Cr]+8[% P]+150B*) is sequentially decreased at the same Mn equivalent. When the steel A, steel B, and steel C are compared with each other at the same heating rate, the ratio of the second phase present at the grain boundary triple points is increased, and YP is decreased in the order of steel A, steel B, and steel C. In addition, from steel D and E, it is found that when [Mneq]≥2.2 holds, the ratio of martensite and retained γ in the second phase is increased, and a low YP and high TS×λ, (hole expanding ratio) are obtained, and that when the [Mneq] is increased while ([% Mn]+3.3[% Mo])/(1.3[% Cr]+8[% P]+150B*) is controlled in our range, YP is further decreased, and the λ is improved.

In addition, in steel G (TS: 390 MPa steel), H (TS: 490 MPa steel), I (TS: 540 MPa steel), and J (TS: 590 MPa steel) in which the amount of C is sequentially increased, by an increase in TS, YS is increased, and λ is decreased. However, at the same strength level, the above steel has a low YP as well as a high TS×λ (hole expanding ratio) equivalent to or more than that of conventional steel in which the amounts of Mn and Mo and ([% Mn]+3.3[% Mo])/(1.3[% Cr]+8[% P]+150B*) are not controlled.

In each of our steel sheet examples shown in Tables 3 and 4, 80% or more of the second phase is generated in the ferrite grain boundaries, and it is found that to decrease YP while high stretch flangeability is maintained, the ratio of the second phase present at the triple points of the grain boundaries among the ferrite grain boundaries must be increased.

When the annealing temperature, the heating rate in annealing, the primary cooling rate, the holding time in a temperature region of 480° C. or less, and the secondary cooling rate are in predetermined ranges, our steel has a predetermined microstructural form, and good material quality is obtained. In particular, when the heating rate in annealing is decreased, and the holding time in a temperature region of 480° C. or less is decreased, the ratio of the second phase present at the grain boundary triple points is increased, and hence a lower YP and higher hole expanding ratio λ can be obtained.

On the other hand, steel T and Y in which [Mneq] is not appropriately controlled has a high YP and a low hole expanding ratio λ. Steel U in which although [Mneq} is appropriately controlled, ([% Mn]+3.3[% Mo])/(1.3[% Cr]+8[% P]+150B*) is not appropriately controlled has a high YP. Steel AC in which P is excessively added has a high YR Steel AD in which a large amount of Mo is added has a high YP. Steel AE, AF, and AG in which Ti, C, and N are not appropriately controlled each have a high YP.

INDUSTRIAL APPLICABILITY

A high-strength galvanized steel sheet having excellent corrosion resistance, a low YP, and a high hole expanding ratio can be manufactured at a low cost. Since the high-strength galvanized steel sheet has excellent corrosion resistance, excellent surface distortion resistance, and excellent stretch flangeability, an increase in strength and a decrease in thickness of automotive parts can be achieved.

The invention claimed is:

1. A galvanized steel sheet comprising: as a chemical composition of steel, on a percent by mass basis, more than 0.015% to less than 0.10% of C, 0.5% or less of Si, 1.0% to 1.9% of Mn, 0.015% to 0.050% of P, 0.03% or less of S, 0.01% to 0.5% of sol. Al, 0.005% or less of N, less than 0.30% of Cr, 0.005% or less of B, less than 0.15% of Mo, 0.4% or less of V, less than 0.020% of Ti, and the balance being iron and inevitable impurities, in which 2.2≤[Mneq]≤3.1, [% Mn]+3.3[% Mo]≤1.9, and ([% Mn]+3.3[% Mo])/(1.3[% Cr]+8[% P]+150B*)<3.5 are satisfied, wherein as a microstructure of the steel comprises ferrite and a second phase, with a volume fraction of the second phase of 2% to 12% and the second phase includes martensite having a volume fraction of 1% to 10% and retained γ having a volume fraction of 0% to 5%, wherein a ratio of total volume fraction of martensite and retained γ to that of the second phase is 70% or more, and a ratio of the volume fraction of the second phase present at grain boundary triple points to that of the second phase is 50% or more, where [Mneq] indicates [% Mn]+1.3[% Cr]+8[% P]+150B*+2[% V]+3.3[% Mo], B* indicates [% B]+[% Ti]/48×10.8×0.9+[% Al]/27×10.8×0.025, [% Mn], [% Cr], [% P], [% B], [Ti], [% Al], [% V], and [% Mo] indicate the contents of Mn, Cr, P, B, Ti, sol. Al, V, and Mo, respectively, [% B]=0 is represented by B*=0, and B*≥0.0022 is represented by B*=0.0022.

2. The galvanized steel sheet according to claim 1, wherein ([% Mn]+3.3[% Mo])/(1.3[% Cr]+8[% P]+150B*) is less than 2.8.

3. The galvanized steel sheet according to claim 1, further comprising, on a percent by mass basis, at least one of less than 0.02% of Nb, 0.15% or less of W, and 0.1% or less of Zr.

4. The galvanized steel sheet according to claim 1, further comprising, on a percent by mass basis, at least one of 0.5% or less of Cu, 0.5% or less of Ni, 0.01% or less of Ca, 0.01% or less of Ce, 0.01% or less of La, and 0.01% or less of Mg.

5. The galvanized steel sheet according to claim 1, further comprising, on a percent by mass basis, at least one of 0.2% or less of Sn and 0.2% or less of Sb.

6. The galvanized steel sheet according to claim 2, further comprising, on a percent by mass basis, at least one of less than 0.02% of Nb, 0.15% or less of W, and 0.1% or less of Zr.

7. The galvanized steel sheet according to claim 2, further comprising, on a percent by mass basis, at least one of 0.5% or less of Cu, 0.5% or less of Ni, 0.01% or less of Ca, 0.01% or less of Ce, 0.01% or less of La, and 0.01% or less of Mg.

8. The galvanized steel sheet according to claim 3, further comprising, on a percent by mass basis, at least one of 0.5% or less of Cu, 0.5% or less of Ni, 0.01% or less of Ca, 0.01% or less of Ce, 0.01% or less of La, and 0.01% or less of Mg.

9. The galvanized steel sheet according to claim 2, further comprising, on a percent by mass basis, at least one of 0.2% or less of Sn and 0.2% or less of Sb.

10. The galvanized steel sheet according to claim 3, further comprising, on a percent by mass basis, at least one of 0.2% or less of Sn and 0.2% or less of Sb.

11. The galvanized steel sheet according to claim 4, further comprising, on a percent by mass basis, at least one of 0.2% or less of Sn and 0.2% or less of Sb.

12. A method for manufacturing a galvanized steel sheet comprising:

performing hot rolling and cold rolling of a steel slab having the chemical composition of claim 1;

then in a continuous galvanizing line (CGL), performing heating in a range of 680° C. to 750° C. at an average heating rate of less than 5.0° C./sec;

subsequently performing annealing at an annealing temperature of 750° C. to 830° C.;

performing cooling to set an average cooling rate from the annealing temperature to immersion in a galvanizing bath to 2° C. to 30° C./sec and to set a holding time in a temperature region of 480° C. or less during cooling to 30 seconds or less;

then performing galvanizing by immersion in a galvanizing bath; and performing cooling to 300° C. or less at an average cooling rate of 5° C. to 100° C./sec after the galvanizing, or further performing an alloying treatment after the galvanizing, and performing cooling to 300° C. or less at an average cooling rate of 5° C. to 100° C./sec after the alloying treatment.

13. A method for manufacturing a galvanized steel sheet comprising:

performing hot rolling and cold rolling of a steel slab having the chemical composition of claim 2;

then in a continuous galvanizing line (CGL), performing heating in a range of 680° C. to 750° C. at an average heating rate of less than 5.0° C./sec;

subsequently performing annealing at an annealing temperature of 750° C. to 830° C.;

performing cooling to set an average cooling rate from the annealing temperature to immersion in a galvanizing bath to 2° C. to 30° C./sec and to set a holding time in a temperature region of 480° C. or less during cooling to 30 seconds or less;

then performing galvanizing by immersion in a galvanizing bath; and performing cooling to 300° C. or less at an average cooling rate of 5° C. to 100° C./sec after the galvanizing, or further performing an alloying treatment after the galvanizing, and performing cooling to 300° C. or less at an average cooling rate of 5° C. to 100° C./sec after the alloying treatment.

14. A method for manufacturing a galvanized steel sheet comprising:

performing hot rolling and cold rolling of a steel slab having the chemical composition of claim 3;

then in a continuous galvanizing line (CGL), performing heating in a range of 680° C. to 750° C. at an average heating rate of less than 5.0° C./sec;

subsequently performing annealing at an annealing temperature of 750° C. to 830° C.;

performing cooling to set an average cooling rate from the annealing temperature to immersion in a galvanizing bath to 2° C. to 30° C./sec and to set a holding time in a temperature region of 480° C. or less during cooling to 30 seconds or less;

then performing galvanizing by immersion in a galvanizing bath; and performing cooling to 300° C. or less at an average cooling rate of 5° C. to 100° C./sec after the galvanizing, or further performing an alloying treatment after the galvanizing, and performing cooling to 300° C. or less at an average cooling rate of 5° C. to 100° C./sec after the alloying treatment.

15. A method for manufacturing a galvanized steel sheet comprising:

performing hot rolling and cold rolling of a steel slab having the chemical composition of claim 4;

then in a continuous galvanizing line (CGL), performing heating in a range of 680° C. to 750° C. at an average heating rate of less than 5.0° C./sec;

subsequently performing annealing at an annealing temperature of 750° C. to 830° C.;

performing cooling to set an average cooling rate from the annealing temperature to immersion in a galvanizing bath to 2° C. to 30° C./sec and to set a holding time in a temperature region of 480° C. or less during cooling to 30 seconds or less;

then performing galvanizing by immersion in a galvanizing bath; and performing cooling to 300° C. or less at an average cooling rate of 5° C. to 100° C./sec after the galvanizing, or further performing an alloying treatment after the galvanizing, and performing cooling to 300° C. or less at an average cooling rate of 5° C. to 100° C./sec after the alloying treatment.

16. A method for manufacturing a galvanized steel sheet comprising:

performing hot rolling and cold rolling of a steel slab having the chemical composition of claim 5;

then in a continuous galvanizing line (CGL), performing heating in a range of 680° C. to 750° C. at an average heating rate of less than 5.0° C./sec;

subsequently performing annealing at an annealing temperature of 750° C. to 830° C.;

performing cooling to set an average cooling rate from the annealing temperature to immersion in a galvanizing bath to 2° C. to 30° C./see and to set a holding time in a temperature region of 480° C. or less during cooling to 30 seconds or less;

then performing galvanizing by immersion in a galvanizing bath; and performing cooling to 300° C. or less at an average cooling rate of 5° C. to 100° C./sec after the galvanizing, or further performing an alloying treatment after the galvanizing, and performing cooling to 300° C. or less at an average cooling rate of 5° C. to 100° C./sec after the alloying treatment.

* * * * *

UNITED STATES PATENT AND TRADEMARK OFFICE

CERTIFICATE OF CORRECTION

PATENT NO. : 9,255,318 B2
APPLICATION NO. : 13/380371
DATED : February 9, 2016
INVENTOR(S) : Ono et al.

It is certified that error appears in the above-identified patent and that said Letters Patent is hereby corrected as shown below:

Specification

In column 19

At Table 1, Steel No. S, subheading "(A)", please change "1.03" to -- 1.63 --.

In column 21

At Table 2-continued, Steel No. AL, subheading "(A)", please change "1.03" to -- 1.53 --.

Signed and Sealed this
Twelfth Day of July, 2016

Michelle K. Lee

Michelle K. Lee
*Director of the United States Patent and Trademark Office*